US010137912B2

(12) United States Patent
de Albuquerque Gleizer et al.

(10) Patent No.: US 10,137,912 B2
(45) Date of Patent: Nov. 27, 2018

(54) SYSTEM FOR CONTROLLING OR MONITORING A VEHICLE SYSTEM ALONG A ROUTE

(71) Applicant: General Electric Company, Schenectady, NY (US)

(72) Inventors: Gabriel de Albuquerque Gleizer, Rio de Janeiro (BR); Carlos Gonzaga, Rio de Janeiro (BR); Lucas Vargas, Rio de Janeiro (BR); Anup Menon, Niskayuna, NY (US); Dan Dai, Niskayuna, NY (US); Harry Kirk Matthews, Jr., Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/439,424

(22) Filed: Feb. 22, 2017

(65) Prior Publication Data

US 2018/0118237 A1 May 3, 2018

Related U.S. Application Data

(60) Provisional application No. 62/414,984, filed on Oct. 31, 2016, provisional application No. 62/414,974, filed on Oct. 31, 2016.

(51) Int. Cl.
*B61L 3/00* (2006.01)
*B61L 3/02* (2006.01)
(Continued)

(52) U.S. Cl.
CPC ..... *B61L 3/008* (2013.01); *B61L 3/006* (2013.01); *B61L 3/02* (2013.01); *B61L 15/0027* (2013.01);
(Continued)

(58) Field of Classification Search
CPC .. B61L 3/008; B61L 3/006; B61L 3/02; B61L 2201/00; B61L 27/0055
See application file for complete search history.

(56) References Cited

U.S. PATENT DOCUMENTS 4,041,283 A 8/1977 Mosier
6,144,901 A 11/2000 Nickles et al.
(Continued)

OTHER PUBLICATIONS

Zhuan et al.; Optimal Scheduling and Control of Heavy Haul Trains Equipped with Electronically Controlled Pneumatic Braking Systems; IEEE Transactions on Control Systems Technology; vol. 15, No. 6; Nov. 2007; 8 pages.
(Continued)

*Primary Examiner* — Michael J Zanelli
(74) *Attorney, Agent, or Firm* — GE Global Patent Operation; Nitin Joshi

(57) ABSTRACT

System having one or more processors that are configured to (a) generate, as a vehicle system moves along a route, a plurality of different trial plans for an upcoming segment of the route. The trial plans include potential operational settings of the vehicle system along the route. The one or more processors that are configured to (b) select one of the trial plans as a selected plan or generate the selected plan based on one or more of the trial plans. The selected plan is configured to improve one or more system-handling metrics as the vehicle system moves along the upcoming segment of the route. The one or more processors are configured to (c) communicate instructions to change or not change at least one of the operational settings of the vehicle system based on the selected plan.

19 Claims, 7 Drawing Sheets

(51) Int. Cl.
*B61L 27/00* (2006.01)
*B61L 15/00* (2006.01)

(52) U.S. Cl.
CPC ..... *B61L 15/0072* (2013.01); *B61L 27/0027* (2013.01); *B61L 27/0038* (2013.01); *B61L 27/0055* (2013.01); *B61L 2201/00* (2013.01)

(56) References Cited

U.S. PATENT DOCUMENTS 6,243,694 B1 6/2001 Bonissone et al.
6,332,106 B1 12/2001 Hawthorne et al.
6,760,712 B1 7/2004 Bonissone et al.
6,763,291 B1 7/2004 Houpt et al.
7,127,336 B2 10/2006 Houpt et al.
7,590,485 B2 9/2009 Daum et al.
8,229,607 B2 7/2012 Hrdlicka et al.
8,406,942 B2 3/2013 Siddappa et al.
8,655,516 B2 2/2014 Noffsinger et al.
8,838,302 B2 * 9/2014 Kumar ..... B60L 15/38 180/14.1
9,233,696 B2 1/2016 Kumar et al.
9,669,811 B2 6/2017 Brooks et al.
9,676,403 B2 6/2017 Brooks et al.
9,937,936 B2 4/2018 Brooks et al.
2010/0174427 A1 7/2010 Sivasubramaniam et al.
2011/0118899 A1 5/2011 Brooks et al.
2013/0277505 A1 10/2013 Kumar et al.
2014/0129109 A1 * 5/2014 Meyer ..... B61L 15/0027 701/82
2014/0222259 A1 * 8/2014 Yoshimoto ..... B61L 27/0027 701/20
2014/0316618 A1 10/2014 Matthews, Jr. et al.
2014/0343835 A1 * 11/2014 Cooper ..... B61L 23/00 701/300
2015/0025737 A1 1/2015 Hermsen et al.
2015/0168158 A1 6/2015 Matthews, Jr. et al.
2016/0244077 A1 * 8/2016 Di Cairano ..... B61L 3/008
2017/0274915 A1 9/2017 Vargas et al.

OTHER PUBLICATIONS

Zhou et al.; In-train forces from energy-efficient driving strategies; 22nd National Conference of the Australian Society for Operations Research; Dec. 2013; 7 pages.

Zhang et al., "Energy-efficient operation of heavy haul trains in an MPC framework", Intelligent Rail Transportation (ICIRT), 2013 IEEE International Conference on, pp. 105-110, Aug. 30-Sep. 1, 2013, Beijing.

* cited by examiner

SYSTEM FOR CONTROLLING OR MONITORING A VEHICLE SYSTEM ALONG A ROUTE

CROSS-REFERENCE TO RELATED APPLICATIONS

The present application claims the benefit of U.S. Provisional Application Nos. 62/414,974 and 62/414,984, each of which was filed on Oct. 31, 2016 and each of which is incorporated herein by reference in its entirety.

FIELD

Embodiments of the subject matter described herein relate to controlling or monitoring a vehicle system as the vehicle system travels along a designated routes.

BACKGROUND

Vehicle systems may include a plurality of vehicles that are connected to one another through couplers. The vehicles of a train, for instance, often include multiple locomotives (e.g., two, three, four, or more locomotives) and numerous rail vehicles (e.g., tens or hundreds of rail vehicles). The locomotives may have separate positions along a length of the train. For example, a first locomotive may be the leading vehicle of the train, a second locomotive may be positioned at about one-third of the length of the train, and a third locomotive may be positioned at about two-thirds of the length of the train. The locomotives collectively drive the train along a designated route. The length of the train may be a mile or greater, and the terrain along the route is often uneven with numerous turns. As such, separate vehicles of the train may experience different forces. For example, one locomotive may be moving along an incline while another locomotive is moving along a decline and/or a turn.

Each vehicle is coupled to one or two adjacent vehicles through the couplers. A coupler may include, among other things, one or more springs, dampers, and/or friction blocks. While the train moves along the track as described above, the couplers exhibit dynamic forces (e.g., compression, expansion, or zero force in a dead zone). The compression or expansion forces can damage the couplers when they exceed designated values. These forces can also cause fatigue during the lifetime operation of the coupler that renders the coupler more susceptible to damage. When a coupler is damaged, it may be necessary to stop the train and allow an individual to replace the damaged coupler. Accordingly, reducing the likelihood of damage to couplers may, among other things, decrease overall operational costs, decrease downtime, and increase network reliance on the schedule of a train.

Known vehicle systems may operate according to a trip plan that specifies how the vehicle system should operate to meet or achieve certain objectives during the trip. For example, the trip plan may specify throttle settings or brake settings of the vehicle system as a function of time, location, and/or other parameters. The trip plan may be created to, among other things, reduce the likelihood that the couplers are damaged. Constraints in creating the trip plan may include estimated arrival times, speed limits, emission limits, slow orders, and the like. Other information may be used to generate the trip plan, such as the length and weight of the vehicles, the grade and conditions of the route that the vehicle will be traversing, weather conditions, performance of the vehicle, slow orders for certain segments of the route, and/or the like.

Train handling can be a difficult problem to address while simultaneously attempting to achieve the other objectives in the trip plan (e.g., fuel efficiency, arrival time). For instance, the control system of the train (or the driver of the train) may be able to control only a few parameters, such as a notch setting or air brakes, as the train moves along the route. The train, however, may have hundreds of vehicles and, consequently, hundreds of couplers that connect the vehicles. As the train moves along a route, the individual vehicles may have different speeds and/or accelerations with respect to one another. If two adjacent vehicles have substantially different speeds, the compression or expansion forces between the two vehicles may damage the connecting coupler.

Presently, the control system may monitor a speed of the lead locomotive and compare that value to a value of the trip plan. For example, the measured value may be the actual speed of the lead locomotive and the planned value may be the center-of-mass (CM) speed of the train. If the values differ, the control system adjusts the operational settings of the train. As an example, if the speed of the lead locomotive at the notch setting of the trip plan exceeds the CM speed of the trip plan, the control system may automatically lower the notch setting or settings and/or activate the braking system. Although the above process may be effective in many situations, the couplers are still at risk of being damaged, especially along routes with an uneven terrain. Moreover, the lead speed, which represents the speed of a single vehicle, varies more than the CM speed, which is a function of the speeds of all the system vehicles. As such, the control system may frequently change the operational settings when such changes may be unnecessary.

It may also be desirable to monitor the performance of the vehicle system to determine whether the performance sufficiently matches the performance dictated by the trip plan. For example, the trip plan is often constructed based on a center-of-mass speed of the vehicle system. If the center-of-mass speed of the vehicle system as it travels along the route does not sufficiently match the center-of-mass speed dictated by the trip plan, adjustments to the operational settings can be made.

Accordingly, a need exists for alternative systems and methods for controlling operation of a vehicle system along a route to reduce the likelihood of damage to couplers of the vehicle system and/or to increase the likelihood that the performance of the vehicle system sufficiently matches the performance dictated by the trip plan.

BRIEF DESCRIPTION

In an embodiment, a system is provided that includes a control system used to control operation of a vehicle system. The vehicle system includes a plurality of system vehicles in which adjacent system vehicles are operatively coupled such that the adjacent system vehicles are permitted to move relative to one another. The vehicle system exhibits system-handling metrics as the vehicle system moves along the route. The control system includes one or more processors that are configured to (a) generate, as the vehicle system moves along the route, a plurality of different trial plans for an upcoming segment of the route. The trial plans include potential operational settings of the vehicle system along the route. The one or more processors that are configured to (b) select one of the trial plans as a selected plan or generate the selected plan based on one or more of the trial plans. The selected plan is configured to improve one or more system-handling metrics as the vehicle system moves along the upcoming segment of the route. The one or more processors that are configured to (c) communicate instructions to change at least one of the operational settings of the vehicle system based on the selected plan or decide to not change any operational settings.

In some aspects, the one or more processors are also configured to (d) repeat (a) through (c) a plurality of times along the route. Optionally, (a)-(d) constitute a model predictive control (MPC) process.

In some aspects, the plurality of different trial plans are iteratively or recursively generated such that performance of the vehicle system converges upon a desired outcome that is based upon an objective function. The selected plan is based on at least one of the trial plans. Optionally, the plurality of different trial plans are iteratively or recursively generated until a condition is satisfied.

In some aspects, each of the plurality of different trial plans specify operational settings from a first position to a second position, the selected plan better improving, compared to at least one other trial plan, the one or more system-handling metrics.

In some aspects the selected plan is not any of the trial plans but is a function of at least one of the trial plans.

In some aspects, the adjacent system vehicles are physically connected by couplers.

In some aspects, the operational settings provide at least one of tractive efforts and braking efforts.

In some aspects, the vehicle system is configured to be controlled in accordance with a current trip plan that dictates operational settings that provide at least one of tractive efforts and braking efforts of the vehicle system along the route.

In some aspects, the system-handling metrics include or are directly related to at least one of: (a) relative acceleration between the system vehicles or groups of the system vehicles along the upcoming segment; (b) relative speed between the system vehicles or groups of the system vehicles along the upcoming segment; (c) relative momentum between the system vehicles or groups of the system vehicles along the upcoming segment; (d) relative displacement between the system vehicles or groups of the system vehicles along the upcoming segment; (e) difference between relative displacement and steady state displacement between the system vehicles or groups of the system vehicles; (f) difference between estimated dynamic force and steady state force between the system vehicles or groups of the system vehicles; (g) a time derivative of forces between the system vehicles or groups of the system vehicles; (h) a product between forces and time derivative of force between the system vehicles or groups of the system vehicles; (i) compression or expansion forces between the system vehicles; (j) rope forces between the system vehicles; (k) a function of the coupler forces and/or the rope forces; (l) or a function that includes some or all of the above.

In some aspects, the system vehicles form a plurality of groups, the groups including a series of coupled system vehicles, wherein the forces and/or relative speeds between the adjacent system vehicles in a common group are assumed to be sufficiently close when generating the trial plans. The system-handling metrics may include relative characteristics of the adjacent groups, such as relative speeds, relative displacements, or relative forces.

In some aspects, each of the trial plans is based on predicted forces over time, vehicle system data, and route data.

In some aspects, the one or more processors are also configured to obtain a reference metric of the vehicle system as the vehicle system moves along the route. The trial plans generated by the one or more processors may be based on the reference metric.

In some aspects, the vehicle system is a train and the system vehicles include at least one locomotive configured to provide tractive efforts and a plurality of rail vehicles. The selected plan is configured to reduce along the upcoming segment, compared to the current trip plan, a risk of damage to the couplers that is caused by rope forces or dynamic forces being excessive.

In an embodiment, a method is provided that includes (a) generating a plurality of different trial plans for an upcoming segment of the route. The trial plans include potential operational settings of the vehicle system along the route. The vehicle system includes a plurality of system vehicles in which adjacent system vehicles are operatively coupled permitting the adjacent system vehicles to move relative to one another. The vehicle system exhibits system-handling metrics as the vehicle system moves along the route. The method also includes (b) selecting one of the trial plans as a selected plan or generating the selected plan based on one or more of the trial plans. The selected plan is configured to improve one or more system-handling metrics as the vehicle system moves along the upcoming segment of the route. The method also includes (c) communicating instructions to change at least one of the operational settings of the vehicle system based on the selected plan or decide to not change any operational settings.

In some aspects, the method also includes (d) repeating (a) through (c) a plurality of times as the vehicle system moves along the route. Optionally, (a)-(d) constitute a model predictive control (MPC) process and are performed by an off-board control system, wherein (c) includes communicating the instructions to the vehicle system from the off-board control system.

In some aspects, the plurality of different trial plans are iteratively or recursively generated such that performance of the vehicle system converges upon a desired outcome that is based upon an objective function, the selected plan being based on at least one of the trial plans.

In some aspects, the plurality of different trial plans are iteratively or recursively generated until a condition is satisfied.

In some aspects, each of the plurality of different trial plans specify operational settings from a first position of the route to a second position of the route. The selected plan better improving, compared to at least one other trial plans, the one or more system-handling metrics. Optionally, the selected plan may better improve, compared to at least two, three, four, or five other trial plans, the one or more system-handling metrics.

In some aspects, the selected plan is not any of the trial plans but is a function of at least one of the trial plans.

In some aspects, the adjacent system vehicles are physically connected by couplers.

In some aspects, the operational settings provide at least one of tractive efforts and braking efforts.

In some aspects, the vehicle system is configured to be controlled in accordance with a current trip plan that dictates operational settings that provide at least one of tractive efforts and braking efforts of the vehicle system along the route.

In some aspects, the system-handling metrics include or are directly related to at least one of: (a) relative acceleration between the system vehicles or groups of the system vehicles along the upcoming segment; (b) relative speed between the system vehicles or groups of the system vehicles along the upcoming segment; (c) relative momentum between the system vehicles or groups of the system vehicles along the upcoming segment; (d) relative displacement between the system vehicles or groups of the system vehicles along the upcoming segment; (e) difference between relative displacement and steady state displacement between the system vehicles or groups of the system vehicles; (f) difference between estimated dynamic force and steady state force between the system vehicles or groups of the system vehicles; (g) a time derivative of forces between the system vehicles or groups of the system vehicles; (h) a product between forces and time derivative of force between the system vehicles or groups of the system vehicles; (i) compression or expansion forces between the system vehicles; (j) rope forces between the system vehicles; (k) a function of the coupler forces and/or the rope forces; (l) or a function that includes some or all of the above.

In some aspects, the method also includes dividing the system vehicles into a plurality of groups. The groups include a series of operatively coupled system vehicles, wherein the forces and/or relative speeds between the adjacent system vehicles in a common group are assumed to be sufficiently close when generating the trial plans.

In some aspects, the vehicle system is a train and the system vehicles include at least one locomotive configured to provide tractive efforts and a plurality of rail vehicles. The selected plan is configured to reduce along the upcoming segment, compared to the current trip plan, a risk of damage to the couplers that is caused by rope forces or dynamic forces being excessive.

In an embodiment, a tangible and non-transitory computer readable medium configured to control operation of a vehicle system is provided. The vehicle system includes a plurality of system vehicles in which adjacent system vehicles are operatively coupled permitting the adjacent system vehicles to move relative to one another. The vehicle system exhibits system-handling metrics as the vehicle system moves along the route. The computer readable medium includes one or more programmed instructions configured to direct one or more processors to (a) generate, as the vehicle system moves along the route, a plurality of different trial plans for an upcoming segment of the route, the trial plans including potential operational settings of the vehicle system along the route. The one or more programmed instructions may also be configured to (b) select one of the trial plans as a selected plan or generate the selected plan based on one or more of the trial plans. The selected plan is configured to improve one or more system-handling metrics as the vehicle system moves along the upcoming segment of the route. The one or more programmed instructions may also be configured to (c change at least one of the operational settings of the vehicle system based on the selected plan or decide to not change any operational settings.

In some aspects, the one or more programmed instructions are configured to direct the one or more processors to (d) repeat (a) through (c) a plurality of times as the vehicle system moves along the route. Optionally, (a)-(d) constitute a model predictive control (MPC) process and are performed by an off-board control system, wherein (c) includes communicating the instructions to the vehicle system from the off-board control system.

In some aspects, the plurality of different trial plans are iteratively or recursively generated such that performance of the vehicle system converges upon a desired outcome that is based upon an objective function, the selected plan being based on at least one of the trial plans. Optionally, the plurality of different trial plans are iteratively or recursively generated until a condition is satisfied.

In some aspects, each of the plurality of different trial plans specify operational settings from a first position to a second position, the selected plan better improving, compared to at least one other trial plans, the one or more system-handling metrics.

In some aspects, the selected plan is not any of the trial plans but is a function of at least one of the trial plans.

In some aspects, the operational settings provide at least one of tractive efforts and braking efforts.

In some aspects, the vehicle system is configured to be controlled in accordance with a current trip plan that dictates operational settings that provide at least one of tractive efforts and braking efforts of the vehicle system along the route.

In some aspects, the system-handling metrics include or are directly related to at least one of: (a) relative acceleration between the system vehicles or groups of the system vehicles along the upcoming segment; (b) relative speed between the system vehicles or groups of the system vehicles along the upcoming segment; (c) relative momentum between the system vehicles or groups of the system vehicles along the upcoming segment; (d) relative displacement between the system vehicles or groups of the system vehicles along the upcoming segment; (e) difference between relative displacement and steady state displacement between the system vehicles or groups of the system vehicles; (f) difference between estimated dynamic force and steady state force between the system vehicles or groups of the system vehicles; (g) a time derivative of forces between the system vehicles or groups of the system vehicles; (h) a product between forces and time derivative of force between the system vehicles or groups of the system vehicles; (i) compression or expansion forces between the system vehicles; (j) rope forces between the system vehicles; (k) a function of the coupler forces and/or the rope forces; (l) or a function that includes some or all of the above.

In some aspects, the one or more programmed instructions are configured to direct the one or more processors to divide the system vehicles into a plurality of groups. The groups include a series of operatively coupled system vehicles, wherein the forces and/or relative speeds between the adjacent system vehicles in a common group are assumed to be sufficiently close when generating the trial plans.

In some aspects, the vehicle system is a train and the system vehicles include at least one locomotive configured to provide tractive efforts and a plurality of rail vehicles, and wherein the selected plan is configured to reduce along the upcoming segment, compared to the current trip plan, a risk of damage to the couplers that is caused by rope forces or dynamic forces being excessive.

In an embodiment, a system is provided that is configured to generate a trip plan for a vehicle system moving along a route. The vehicle system has system vehicles in which adjacent system vehicles are operatively coupled such that the adjacent system vehicles are permitted to move relative to one another. The vehicle system exhibits system-handling metrics as the vehicle system moves along the route. The control system includes one or more processors that are configured to (a) generate a plurality of different trial plans for an upcoming segment of the route. The trial plans include potential operational settings of the vehicle system along the route. The one or more processors that are configured to (b) select one of the trial plans as a selected plan or generate the selected plan based on one or more of the trial plans. The selected plan is configured to improve one or more system-handling metrics as the vehicle system moves along the upcoming segment of the route.

In some aspects, the one or more processors are also configured to (c) repeat (a) and (b) a plurality of times along the route for different or overlapping upcoming segments until the trial plan is completed for the entire route or a designated portion of the route. In some aspects, (a)-(c) constitute a model predictive control (MPC) process.

In an embodiment, a method is provided that is configured to generate a trip plan for a vehicle system moving along a route. The vehicle system has system vehicles in which adjacent system vehicles are operatively coupled such that the adjacent system vehicles are permitted to move relative to one another. The vehicle system exhibits system-handling metrics as the vehicle system moves along the route. The method includes (a) generating a plurality of different trial plans for an upcoming segment of the route. The trial plans include potential operational settings of the vehicle system along the route. The method also includes (b) selecting one of the trial plans as a selected plan or generate the selected plan based on one or more of the trial plans. The selected plan is configured to improve one or more system-handling metrics as the vehicle system moves along the upcoming segment of the route.

In some aspects, the method is also configured to (c) repeat (a) and (b) a plurality of times along the route for different or overlapping upcoming segments until the trial plan is completed for the entire route or a designated portion of the route. In some aspects, (a)-(c) constitute a model predictive control (MPC) process.

In an embodiment, a system is provided that includes a control system used to control operation of a vehicle system as the vehicle system moves along a route. The vehicle system includes a plurality of system vehicles in which adjacent system vehicles are operatively coupled such that the adjacent system vehicles are permitted to move relative to one another. The control system includes one or more processors that are configured to (a) receive operational settings of the vehicle system and (b) input the operational settings into a system model of the vehicle system to determine an observed metric of the vehicle system. The one or more processors are also configured to (c) compare the observed metric to a reference metric and (d) modify the operational settings of the vehicle system based on differences between the observed and the reference metrics.

In some aspects, (a)-(d) are repeated a plurality of times as the vehicle system moves along the route.

In some aspects, the reference metric includes or is based on at least one of: a speed metric; accelerations of the system vehicles; steady state or dynamic forces; a length of the vehicle system, an internal energy of couplers; momentum transfer; relative separation of the system vehicles; or a function of one or more of the above.

In some aspects, the control system controls the vehicle system in accordance with a current trip plan that dictates the operational settings of the vehicle system. The reference metric is derived from the current trip plan.

In some aspects, the observed metric is a center of mass (CM) speed of the vehicle system.

In some aspects, the one or more processors are also configured to receive a system-handling metric of the vehicle system. The system-handling metric being a first type of metric and the observed metric being a different second type of metric, wherein (a) includes changing states of the system model based on the system-handling metric prior to determining the observed metric. Optionally, the system-handling metric is a speed metric of one of the system vehicles of the vehicle system.

In some aspects, the system-handling metric is a system-handling metric of a system vehicle at a first position within the vehicle system and the observed metric is a system-handling metric of a system vehicle at a second position within the vehicle system. Optionally, the system-handling metric of the system vehicle at the first position is a speed metric and the observed metric of the system vehicle at the second position is also a speed metric. Optionally, the one or more processors are also configured to compute an error between the speed metrics of the system vehicles at the first and second positions. The one or more processors being configured to adjust the operational settings of the vehicle system based on the error.

In some aspects, (a) includes computing an error between the system-handling metric of the first type and an estimated metric of the first type. The estimated metric of the first type is determined by executing the system model with the operational settings of the vehicle system, wherein (a) also includes adjusting states of the system model as a function of the error. The system model providing the observed metric of the second type after the states of the system model are adjusted. The estimated metric and the system-handling metric may be, for example, a vehicle speed of a common vehicle, such as the lead vehicle.

In some aspects, the reference metric is a system-handling metric of a system vehicle at a first position within the vehicle system and the observed metric is a system-handling metric of a system vehicle at a second position within the vehicle system.

In an embodiment, a method is provided that includes controlling operation of a vehicle system as the vehicle system moves along a route. The vehicle system includes a plurality of system vehicles in which adjacent system vehicles are operatively coupled such that the adjacent system vehicles are permitted to move relative to one another. The method also includes (a) receiving operational settings of the vehicle system and (b) inputting the operational settings into a system model of the vehicle system to determine an observed metric of the vehicle system. The method also includes (c) comparing the observed metric to a reference metric and (d) modifying the operational settings of the vehicle system based on differences between the observed metric and the reference metric.

Optionally, (a)-(d) are repeated a plurality of times as the vehicle system moves along the route.

In some aspects, the method also includes receiving a system-handling metric of the vehicle system. The system-handling metric is a first type of metric and the observed metric being a different second type of metric, wherein (a) includes changing states of the system model based on the system-handling metric prior to determining the observed metric. Optionally, the system-handling metric is a speed metric of one of the system vehicles of the vehicle system.

In some aspects, the system-handling metric is a system-handling metric of a system vehicle at a first position within the vehicle system and the observed metric is a system-handling metric of a system vehicle at a second position within the vehicle system. Optionally, the system-handling metric of the system vehicle at the first position is a speed metric and the observed metric of the system vehicle at the second position is also a speed metric. Optionally, the method also includes computing an error between the speed metrics of the system vehicles at the first and second positions and adjusting the operational settings of the vehicle system based on the error.

In some aspects, (a) includes computing an error between the system-handling metric of the first type and an estimated metric of the first type. The estimated metric of the first type being determined by executing the system model with the operational settings of the vehicle system, wherein (a) also includes adjusting states of the system model as a function of the error. The system model provides the observed metric of the second type after the states of the system model are adjusted.

In some aspects, the reference metric is a system-handling metric of a system vehicle at a first position within the vehicle system and the observed metric is a system-handling metric of a system vehicle at a second position within the vehicle system.

In an embodiment, a system is provided that includes a control system used to control operation of a vehicle system as the vehicle system moves along a route. The vehicle system includes a plurality of system vehicles in which adjacent system vehicles are operatively coupled such that the adjacent system vehicles are permitted to move relative to one another. The control system includes one or more processors that are configured to (a) receive operational settings of the vehicle system and (b) input the operational settings into a system model of the vehicle system to determine a reference metric of the vehicle system. The one or more processors are also configured to (c) compare the reference metric to a system-handling metric of the vehicle system. The reference metric and the system-handling metric are essentially of the same type of metric. The one or more processors are also configured to (d) modify the operational settings of the vehicle system based on differences between the reference metric and the system-handling metric.

In some aspects, the reference metric is calculated using the system model and the operational settings specified by a trip plan of the vehicle system. The system model is a mathematical representation of the vehicle system and includes parameters determined by the route and parameters determined by the system vehicles.

In some aspects, the reference metric is a planned speed of a designated system vehicle of the vehicle system and the system-handling metric is an operating speed of the designated system vehicle of the vehicle system.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
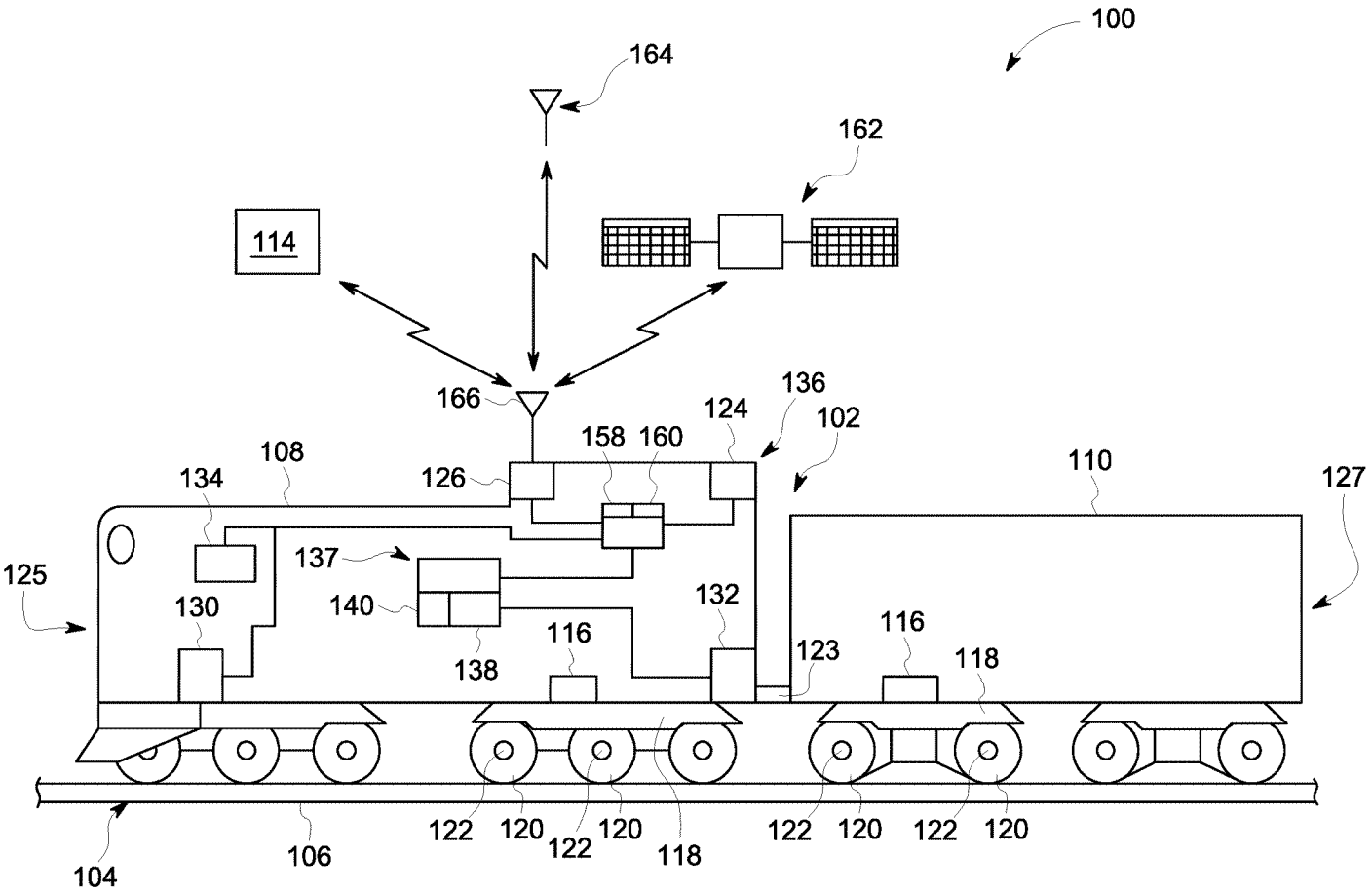
FIG. 1 is a schematic diagram of a vehicle system having a control system in accordance with an embodiment.

Embodiments of the subject matter disclosed herein describe methods and systems used in conjunction with controlling a vehicle system that moves along a route. Embodiments may use a vehicle-motion model as a mathematical representation of the vehicle system to control operation of the vehicle system as the vehicle system moves along the route. The vehicle-motion model includes equations that represent movement dynamics of the vehicle system along the route, including the relative movement among individual vehicles of the vehicle system. Inputs to the vehicle-motion model, such as data regarding the operational settings of the vehicle system, the makeup of the vehicle system, and the route, may be used to generate one or more plans for future operation of the vehicle system.

Optionally, embodiments may include a control system disposed onboard the vehicle system. The control system, however, may be disposed off-board (e.g., at a dispatch location and/or as part of a cloud computing system). In some embodiments, the control system is configured to directly or indirectly adjust operation of the vehicle system. For example, the control system may adjust operation of the vehicle system so that the vehicle system travels in accordance with a trip plan or to reduce the likelihood that the vehicle system may become damaged during a trip along the route. As another example, the control system may adjust operation of the vehicle system to improve performance or achieve one or more objectives. One or more embodiments may also include methods and systems for generating a trip plan to reduce the likelihood that the vehicle system may become damaged during a trip along the route and/or to improve performance or achieve one or more objectives.

In some embodiments, a control system is provided that is configured to control (directly or indirectly) operation of a vehicle system. The vehicle system includes a plurality of system vehicles in which adjacent system vehicles are operatively coupled to each other such that the adjacent system vehicles are permitted to move relative to one another. The vehicle system may be a series of vehicles that are operatively coupled with one another. For example, the system vehicles may be connected through couplers (e.g., mechanical devices that physically connect the adjacent vehicles) or may be magnetically coupled such that physical contact is reduced or eliminated. Accordingly, adjacent system vehicles may be described as being connected through a "coupling," but it should be understood that the coupling does not necessarily require a physical connection. The term "coupler" may be used to represent a device that makes a physical connection (e.g., draft gear devices or end of car cushioning devices). The adjacent vehicles that are operatively coupled may have a separation range. The separation range has a minimum separation distance and a maximum separation distance. For example, the minimum separation distance (e.g., when the coupling is fully compressed) may be, for example, at least 0.1 m, at least 0.2 m, at least 0.3 m, or at least 0.5 m. The maximum separation distance (e.g., when coupling is full expanded without breaking) may be, for example, at most 3.0 m, at most 1.5 m, or at most 1.0 m, or at most 0.5 m. Non-limiting examples of ranges of separation distances include between at least 0.1 meters (m) and at most 2.0 m, between at least 0.1 m and at most 1.0 m, between at least 0.1 m and at most 0.5 m, between at least 0.2 m and at most 0.5 m, or between at least 0.2 m and at most 0.5 m. However, it should be understood that greater or lesser separation distances may be used depending upon the application. This separation distance may change throughout operation as the adjacent vehicles move closer to each other or further from each other. For example, the coupling has slack that permits the adjacent vehicles to float between a minimum separation distance and a maximum separation distance. The separation distance may be measured between the point at which the coupling engages the one system vehicle and the point at which the coupling engages the adjacent system vehicles. Alternatively, the separation distance may be measured between the closest points of the adjacent system vehicles.

The vehicle system includes one or more propulsion-generating vehicles and, optionally, one or more non-propulsion-generating vehicles. In particular embodiments, the vehicle system includes one or more locomotives and one or more rail vehicles. In other embodiments, however, the vehicle system may include one or more other propulsion-generating vehicles. As the vehicle system moves along the route, the couplings (which may or may not include a physical connection) exert forces on the system vehicles. The forces may be coupler forces or rope forces. Rope forces assume that the couplers are rigid or have infinite stiffness. Each coupler also exerts a coupler force as the vehicle system moves along the route. A coupler force is the force exerted on the system vehicle by that particular coupler. For example, the couplers may cause compressing forces or expansion forces based on a displacement of the coupler. The coupler forces and/or rope forces may be calculated, in some embodiments, and used as inputs to the vehicle-motion model. The coupler forces and/or rope forces may also be represented by variables within the vehicle-motion model.

In some embodiments, the vehicle system may be controlled in accordance with a current trip plan as the vehicle system moves along the route. As used herein, a "trip plan" dictates or specifies operational settings that provide at least one of tractive efforts and braking efforts of the vehicle system along the route. The trip plan may designate one or more operational settings for the vehicle system to implement or execute during the trip as a function of time and/or location along the route. The operational settings may include tractive settings (e.g., notch settings) and braking settings for the vehicle system. For example, the operational settings may include dictated speeds, throttle settings, brake settings, accelerations, or the like, for the different system vehicles of the vehicle system as a function of time and/or distance along the route. The trip plan and the different operational settings of the current trip plan may be communicated as a control signal. A trip plan may be modified or adjusted as the vehicle system moves along the route. Accordingly, the term "current trip plan" means the latest version of the trip plan that is currently being implemented.

In some embodiments, a plurality of different trial plans (or simulations) may be generated for an upcoming segment of the route. These trial plans are similar to trip plans and include potential operational settings for providing at least one of tractive efforts and braking efforts of the vehicle system along the route. In some embodiments, the trial plans are effectively different plans that can replace corresponding portions of the current trip plan. In other embodiments, the trial plans are formed by modifying one or more operational settings of the current trip plan for the upcoming segment and/or modifying the timing of implementing the one or more operational settings of the current trip plan for the upcoming segment.

In either of the above examples, the trial plans (or simulations) may be executed using a vehicle-motion model to determine system-handling metrics of the vehicle system along the upcoming segment of the route. The vehicle-motion model may be directly or indirectly driven by the coupler forces and/or rope forces of the vehicle system. Other inputs may include data regarding the makeup of the vehicle system. For example, the makeup data may include a total number of system vehicles, a total number of propulsion-generating vehicles, a total number of non-propulsion-generating vehicles, the weights of the vehicles, the positions of the vehicles relative to one another, and the tractive capabilities of the propulsion-generating vehicles. System-handling metrics relate to how the system vehicles operate individually or how multiple system vehicles interact with one another as the vehicle system moves along the route. The system-handling metrics determined through the trial plans may differ from the system-handling metrics of the current trip plan. One of the trial plans may be selected, which is hereinafter called the "selected plan," and the current trip plan may be changed (e.g., modified, adjusted, or replaced) based on the selected plan. More specifically, the selected plan may be configured to improve one or more of the system-handling metrics compared to the current trip plan. In some embodiments, the selected plan is generated iteratively or recursively such that performance of the vehicle system converges upon a designated performance.

The processes set forth herein may be repeated a plurality of times as the vehicle system moves along the route. Each time may be referred to as an iteration. Tens or hundreds of iterations may occur during a single trip, although it is contemplated that the above steps may be implemented only once in some embodiments. It should be noted, however, that the upcoming segments in different iterations correspond to different segments of the route. The different segments may overlap. For example, an upcoming segment in a first iteration may extend between mile markers 5 and 10 and an upcoming segment in a second iteration may extend between mile markers 7 and 12. Alternatively, the different upcoming segments may not overlap. For example, an upcoming segment in a first iteration may extend between mile markers 5 and 10 and an upcoming segment in a second iteration may extend between mile markers 10 and 15. In different iterations, the current trip plans differ from each other. More specifically, a new current trip plan includes changes to a prior trip plan in which the changes were based on a selected plan.

In some embodiments, the vehicle-motion model may be used to estimate a metric of the vehicle system. For example, the vehicle-motion model may be executed using actual metrics of the vehicle system that can be detected to determine other metrics that may be difficult to detect. Alternatively, the vehicle-motion model may be executed using planned metrics (e.g., operational settings of a trip plan) to determine the other metrics. The estimated (or observed) metric may then be used to control operation of the vehicle system. As used herein, an "observed metric," which may also be referred to as an "estimated metric," is a metric that is estimated using a vehicle-motion model. The observed metric may be either not detected during operation of the vehicle system or not calculated quickly enough with precision during operation of the vehicle system. For example, a center-of-mass (CM) speed may be difficult to reliably detect as the vehicle system moves along the route such that the CM speed may be relied upon to control operation of the vehicle system. More specifically, it may be necessary to determine the CM speed tens or hundreds of times within a minute to control operation of the vehicle system. It may either be impossible or cost prohibitive to determine the CM speed during operation without estimating the metric as described herein.

A more particular description of the inventive subject matter briefly described above will be rendered by reference to specific embodiments thereof that are illustrated in the appended drawings. The inventive subject matter will be described and explained with the understanding that these drawings depict only typical embodiments of the inventive subject matter and are not therefore to be considered to be limiting of its scope. Wherever possible, the same reference numerals used throughout the drawings refer to the same or like parts. To the extent that the figures illustrate diagrams of the functional blocks of various embodiments, the functional blocks are not necessarily indicative of the division between hardware and/or circuitry. Thus, for example, components represented by multiple functional blocks (for example, processors, controllers, or memories) may be implemented in a single piece of hardware (for example, a general purpose signal processor, microcontroller, random access memory, hard disk, or the like). Similarly, any programs and devices may be standalone programs and devices, may be incorporated as subroutines in an operating system, may be functions in an installed software package, or the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

As used herein, the terms "module," "system," "device," or "unit," may include a hardware and/or software system and circuitry that operate to perform one or more functions. For example, a module, unit, device, or system may include a computer processor, controller, or other logic-based device that performs operations based on instructions stored on a tangible and non-transitory computer readable storage medium, such as a computer memory. Alternatively, a module, unit, device, or system may include a hard-wired device that performs operations based on hard-wired logic and circuitry of the device. The modules, units, or systems shown in the attached figures may represent the hardware and circuitry that operates based on software or hardwired instructions, the software that directs hardware to perform the operations, or a combination thereof. The modules, systems, devices, or units can include or represent hardware circuits or circuitry that include and/or are connected with one or more processors, such as one or computer microprocessors.

In some embodiments, the control system may include one or more embedded systems that are configured to perform the steps described herein. For example, one or more embedded systems may generate trial plans and/or execute simulations using a vehicle-motion model. One or more embedded systems may select one of the trial plan or identify the operational settings for one of the simulations. The selected plan or simulation may then be used to control operation of the vehicle system.

As used herein, an "embedded system" is a specialized computing system that is integrated as part of a larger system, such as a larger computing system (e.g., control system) or a vehicle system. An embedded system includes a combination of hardware and software components that form a computational engine that will perform one or more specific functions. Embedded systems are unlike general computers, such as desktop computers, laptop computers, or tablet computers, which may be programmed or re-programmed to accomplish a variety of disparate tasks. Embedded systems include one or more processors (e.g., microcontroller or microprocessor) or other logic-based devices and memory (e.g., volatile and/or non-volatile) and may optionally include one or more sensors, actuators, user interfaces, analog/digital (AD), and/or digital/analog (DA) converters. An embedded system may include a clock (referred to as system clock) that is used by the embedded system for performing its intended function(s), recording data, and/or logging designated events during operation.

Embedded systems described herein include those that may be used to control a vehicle system, such as a locomotive or a consist that includes the locomotive. These embedded systems are configured to operate in time-constrained environments, such as those experienced during a trip, that require the embedded systems to make complex calculations that a human would be unable to perform in a commercially reasonable time. Embedded systems may also be reactive such that the embedded systems change the performance of one or more mechanical devices (e.g., traction motors, braking subsystems) in response to detecting an operating condition. Embedded systems may be discrete units. For example, at least some embedded systems may be purchased and/or installed into the larger system as separate or discrete units.

Non-limiting examples of embedded systems that may be used by a vehicle system, such as those described herein, include a communication management unit (CMU), a consolidated control architecture (CCA), a locomotive command and control module (LCCM), a high performance extended applications platform (HPEAP), and an energy management system (EMS). Such embedded systems may be part of a larger system, which may be referred to as a control system. The larger system may also be the vehicle system (e.g., locomotive). In certain embodiments, the CMU is configured to communicate with an off-board system, such as a dispatch, and generate a trip plan based on input information received from the off-board system. In certain embodiments, the CCA may implement or execute the trip plan by controlling one or more traction motors and braking subsystems. The CCA may receive the trip plan from the CMU and communicate with the CMU as the vehicle system moves along the route. For example, the CMU may communicate a current time to the CCA. In some embodiments, the CCA is configured to modify the trip plan to reduce the likelihood that the couplers will become damaged during operation of the vehicle system.

Although the above describes an onboard embedded system as being configured to modify the trip plan to improve one or more system-handling metrics, it should be understood that other embodiments may not include such an embedded system. For example, the vehicle system or the control system may include a general computer that performs the various generation and selection steps and/or other steps described herein. Yet in other embodiments, embodiments are not disposed on the vehicle system and, instead, the generation and selection steps (and/or other steps) may be performed remotely, such as by an off-board control system. In some embodiments, the control system is or is part of a cloud computing system.

FIG. 1 illustrates a schematic diagram of a control system 100 according to an embodiment. In the illustrated embodiment, the control system 100 is disposed onboard a vehicle system 102. The control system 100 includes one or more processors that are configured to control operation of the vehicle system 102. Optionally, the control system 100 may include other components, such as sensors and mechanical devices used to control operation of the vehicle system 102. Although the control system 100 is disposed onboard the vehicle system 102 in the illustrated embodiment, it should be understood that the control system 100 may be an off-board system in other embodiments located at, for example, a dispatch location. The vehicle system 102 is configured to travel on a route 104. The vehicle system 102 is configured to travel along the route 104 on a trip from a starting or departure location to a destination or arrival location. The vehicle system 102 includes at least one propulsion-generating vehicle 108 and at least one non-propulsion-generating vehicle 110 that are mechanically interconnected to one another in order to travel together along the route 104. As shown, the propulsion-generating vehicle 108 and the non-propulsion-generating vehicle 110 are connected through a coupler 123.

In the illustrated embodiment, only one propulsion-generating vehicle 108 and only one non-propulsion-generating vehicle 110 are shown. It should be understood that the vehicle system 102 may include a plurality of propulsion-generating vehicles 108 (e.g., two, three, four, five, six, or more) and a plurality of non-propulsion-generating vehicles 110 (e.g., ten, twenty, thirty, forty, fifty, a hundred, or more). For example, the vehicle system 102 may be a train configured for heavy-haul applications. The propulsion-generating vehicles 108 and the non-propulsion-generating vehicles 110 may be generically referred to as "system vehicles." In other words, a system vehicle, as used herein, may be a propulsion-generating vehicle 108 or a non-propulsion-generating vehicle 110. The system vehicles 108, 110 are interconnected with one another through one or more of the couplers 123. For example, in some embodiments, the number of couplers is one less than the total number of system vehicles 108, 110.

Two system vehicles 108, 110 that are connected through a coupler 123 may be referred to as adjacent system vehicles (or adjacent vehicles). Two or more coupled propulsion-generating vehicles 108 may form a consist or group. The vehicle system 102 may include a single consist or multiple consists interspersed along the vehicle system 102. In a distributed power operation, the consist may include a lead propulsion-generating vehicle mechanically linked to one or more remote propulsion-generating vehicles, where operational settings (e.g., tractive and braking settings) of the remote propulsion-generating vehicles are controlled by the lead propulsion-generating vehicle.

The propulsion-generating vehicle 108 is configured to generate tractive efforts to propel (for example, pull or push) the non-propulsion-generating vehicle 110 along the route 104. The propulsion-generating vehicle 108 includes a propulsion subsystem, including one or more traction motors, that generates tractive effort to propel the vehicle system 102. The propulsion-generating vehicle 108 also includes a braking subsystem that generates braking effort for the vehicle system 102 to slow down or stop itself from moving. Optionally, the non-propulsion-generating vehicle 110 includes a braking subsystem but not a propulsion subsystem. For ease of reading, the non-propulsion-generating vehicle 110 is hereinafter referred to herein as a car 110. In an alternative embodiment, the vehicle system 102 includes a plurality of propulsion-generating vehicles 108 without any vehicles 110.

The control system 100 is used to control the movements of the vehicle system 102. In the illustrated embodiment, the control system 100 is disposed entirely on the propulsion-generating vehicle 108. The control system 100 may include a plurality of embedded sub-systems, which are hereinafter referred to as embedded systems. In other embodiments, however, one or more components of the control system 100 may be distributed among several vehicles, such as the system vehicles 108, 110 that make up the vehicle system 102. For example, some components may be distributed among two or more propulsion-generating vehicles 108 that are coupled together in a group or consist. In an alternative embodiment, at least some of the components of the control system 100 may be located remotely from the vehicle system 102, such as at a dispatch location 114. The remote components of the control system 100 may communicate with the vehicle system 102 (and with components of the control system 100 disposed thereon). In some embodiments, an entirety of the control system is located off-board. For example, the control system may be located at a remote site or may be part of a cloud computing system.

In the illustrated embodiment, the vehicle system 102 is a rail vehicle system, and the route 104 is a track formed by one or more rails 106. The propulsion-generating vehicle 108 may be a rail vehicle (e.g., locomotive), and the car 110 may be a rail car that carries passengers and/or cargo. The propulsion-generating vehicle 108 may be another type of rail vehicle other than a locomotive, and the non-propulsion generating vehicle 110 may be another type of vehicle other than a rail car (e.g., trailer). In another embodiment, the propulsion-generating vehicles 108 may be trucks and/or automobiles configured to drive on a track 106 composed of pavement (e.g., a highway). The vehicle system 102 may be a group or consist of trucks and/or automobiles that are coupled so as to coordinate movement of the vehicles 108 along the pavement. In other embodiments, the system vehicles 108, 110 may be off-highway vehicles (e.g., mining vehicles and other vehicles that are not designed for or permitted to travel on public roadways) traveling on a track 106 of earth, marine vessels traveling on a track 106 of water, aerial vehicles traveling on a track 106 of air, and the like. Thus, although some embodiments of the inventive subject matter may be described herein with respect to trains, locomotives, and other rail vehicles, embodiments of the inventive subject matter also are applicable for use with vehicles generally that are interconnected through couplers.

The system vehicles 108, 110 of the vehicle system 102 each include multiple wheels 120 that engage the route 104 and at least one axle 122 that couples left and right wheels 120 together (only the left wheels 120 are shown in FIG. 1). Optionally, the wheels 120 and axles 122 are located on one or more trucks or bogies 118. Optionally, the trucks 118 may be fixed-axle trucks, such that the wheels 120 are rotationally fixed to the axles 122, so the left wheel 120 rotates the same speed, amount, and at the same times as the right wheel 120. The propulsion-generating vehicle 108 is mechanically coupled to the car 110 by the coupler 123. The coupler 123 may have a draft gear configured to absorb compression and tension forces to reduce slack between the system vehicles 108, 110. Although not shown in FIG. 1, the propulsion-generating vehicle 108 may have a coupler located at a front end 125 of the propulsion-generating vehicle 108 and/or the car 110 may have a coupler located at a rear end 127 of the car 110 for mechanically coupling the respective vehicles 108, 110 to additional vehicles in the vehicle system 102.

As the vehicle system 102 moves along the route 104 during a trip, the control system 100 may be configured to measure, record, or otherwise receive and collect input information about the route 104, the vehicle system 102, and the movement of the vehicle system 102 on the route 104. For example, the control system 100 may be configured to monitor a location of the vehicle system 102 along the route 104 and a speed at which one or more of the system vehicles 108, 110 move along the route 104, which is hereinafter referred to as a vehicle speed.

In addition, the control system 100 may be configured to generate a trip plan and/or a control signal based on such input information. The trip plan and/or control signal designates one or more operational settings for the vehicle system 102 to implement or execute during the trip as a function of time and/or location along the route 104. The operational settings may include tractive settings (e.g., notch settings) and braking settings for the vehicle system 102. For example, the operational settings may include dictated speeds, throttle settings, brake settings, accelerations, or the like, for the different system vehicles 108, 110 of the vehicle system 102 as a function of time and/or distance along the route 104 traversed by the vehicle system 102.

The trip plan may be configured to achieve or increase specific goals or objectives during the trip of the vehicle system 102, while meeting or abiding by designated constraints, restrictions, and limitations. Some possible objectives include increasing energy (e.g., fuel) efficiency, reducing emissions generated by the vehicle system 102, reducing trip duration, increasing fine motor control, reducing wheel and route wear, and the like. The constraints or limitations include speed limits, schedules (such as arrival times at various designated locations), environmental regulations, standards, and the like. The operational settings of the trip plan are configured to increase the level of attainment of the specified objectives relative to the vehicle system 102 traveling along the route 104 for the trip according to operational settings that differ from the one or more operational settings of the trip plan (e.g., such as if the human operator of the vehicle system 102 determines the tractive and brake settings for the trip). One example of an objective of the trip plan is to increase fuel efficiency (e.g., by reducing fuel consumption) during the trip. By implementing the operational settings designated by the trip plan, the fuel consumed may be reduced relative to travel of the same vehicle system along the same segment of the route in the same time period but not according to the trip plan.

As set forth herein, embodiments may also generate trial plans for an upcoming segment of the route 104 or simulations as the vehicle system 102 moves along the route 104. Embodiments may select one of the trial plans (referred to as a selected plan) for the upcoming segment or one of the simulations. The selected plans may be used to modify the operational settings of the trip plan for the upcoming segment to improve at least one system-handling metric. In particular embodiments, the selected plan is configured to reduce the likelihood that couplers interconnecting the system vehicles 108, 110 will be damaged. The selected plans may also modify the operational settings to attain one or more of the other objectives described above (e.g., fuel consumption, trip duration, etc.). The selected plans may be generated by the control system 100. With respect to simulations, the operational settings for a designated simulation may be used to control operation of the vehicle system.

The upcoming segments are typically a portion of the route 104 that is less than the remaining amount of the route 104. The upcoming segment may be defined, in some embodiments, by a designated distance or by an amount of travel time according to the trip plan. For example, the upcoming segment of the route 104 may be at least one of: (a) at most 20 kilometers (km) or (b) at most 30 minutes of travel time for the upcoming segment according to the trip plan. In certain embodiments, the upcoming segment of the route 104 may be at most 20 km, at most 15 km, at most 10 km, at most 5 km, or less. In certain embodiments, the travel time for the upcoming segment according to the trip plan may be at most 30 minutes, at most 20 minutes, at most 15 minutes, at most 10 minutes, or less.

It is contemplated, however, that the upcoming segment may include the entire portion of the route 104 that extends, for example, from a current position of the vehicle system 102 to a final destination of the trip. In some embodiments, the selected plans are based, at least in part, on the trip plans. For example, the selected plans may include input data and/or input parameters that are determined by (or derived from) the trip plan.

The system-handling metrics are metrics related to how the vehicle system 102 is operating. The system-handling metrics may relate to how individual system vehicles are moving relative to one another or how groups of system vehicles are moving relative to one another. In some embodiments, the system-handling metrics are based on coupler forces and/or rope forces. The selected plan may be configured to improve, compared to the current trip plan, one or more system-handling metrics. In some embodiments, the selected plan may be configured to reduce, compared to the current trip plan, a risk of damage to the couplers that is caused by, for example, excessive compression or excessive expansion.

As used herein, the phrase "improve one or more system-handling metrics" (or derivatives of the phrase) includes (1) improving only a single system-handling metric; (2) improving multiple system-handling metrics; or (3) improving an outcome using a multi-variable function (e.g., objective function, cost function, profit function, or the like) that includes a plurality of variables representing multiple system-handling metrics. In other words, the multi-variable function may be used to find an improved outcome that is determined by a combination of system-handling metrics. As used herein, the term "improve" means more desirable. An improved metric or outcome may be one that is increased or reduced. The term does not require, although it may include, that the improved metric or outcome be optimized (e.g., maximized or minimized).

Non-limiting examples of system-handing metrics include (a) relative acceleration between the system vehicles or groups of the system vehicles along the upcoming segment; (b) relative speed between the system vehicles or groups of the system vehicles along the upcoming segment; (c) relative momentum between the system vehicles or groups of the system vehicles along the upcoming segment; (d) relative displacement between the system vehicles or groups of the system vehicles along the upcoming segment; (e) difference between relative displacement and steady state displacement between the system vehicles or groups of the system vehicles; (f) difference between estimated dynamic force and steady state force between the system vehicles or groups of the system vehicles; (g) a time derivative of forces between the system vehicles or groups of the system vehicles; (h) a product between forces and time derivative of force between the system vehicles or groups of the system vehicles; (i) coupler forces between the system vehicles if couplers physically connect the adjacent system vehicles; (j) rope forces (e.g., steady state forces) between the system vehicles; or (k) a function of the coupler forces and/or the rope forces (e.g., maximum of the coupler and/or rope forces over all of the system vehicles).; or (l) a function that includes one or all of the above. To provide an example of (l), an objective function that can be used may be the sum of the squares of (b).

The trip plan may be established using one or more algorithms based on models for vehicle behavior for the vehicle system 102 along the route. The algorithms may include a series of non-linear differential equations derived from applicable physics equations with simplifying assumptions, such as described in connection with U.S. patent application Ser. No. 12/955,710, U.S. Pat. No. 8,655,516, entitled "Communication System for a Rail Vehicle Consist and Method for Communicating with a Rail Vehicle Consist," which was filed 29 Nov. 2010 (the "'516 patent"), the entire disclosure of which is incorporated herein by reference.

The control system 100 may be configured to control the vehicle system 102 along the trip based on the trip plan, such that the vehicle system 102 travels according to the trip plan. The control system 100 may also be configured to control the vehicle system 102 along the trip based on the selected plan. More specifically, the control system 100 may use operational settings derived from the selected plan and forego using the operational settings determined by the trip plan.

In a closed loop mode or configuration, the control system 100 may autonomously control or implement propulsion and braking subsystems of the vehicle system 102 consistent with the trip plan and/or selected plans, without requiring the input of a human operator. In an open loop coaching mode, the operator is involved in the control of the vehicle system 102 according to the trip plan and/or the selected plans. For example, the control system 100 may present or display the operational settings of the trip plan (or the selected plan) to the operator as directions on how to control the vehicle system 102 to follow the trip plan (or the selected plan). The operator may then control the vehicle system 102 in response to the directions. As an example, the control system 100 may be or include a Trip Optimizer™ system from General Electric Company, or another energy management system. For additional discussion regarding a trip plan, see the '516 patent, the entire disclosure of which is incorporated herein by reference.

The control system 100 may include at least one embedded system. In the illustrated embodiment, the control system 100 includes a first embedded system 136 and a second embedded system 137 that are communicatively coupled to each other. Although the control system 100 is shown as having only two embedded systems, it should be understood that the control system 100 may have more than two embedded systems. In certain embodiments, the first embedded system 136 may be a CMU and the second embedded system 137 may be a CCA.

The first embedded system 136 includes one or more processors 158 and memory 160. The one or more processors 158 may generate a trip plan based on input information received from the second embedded system 137 or other components of the vehicle system 102 and/or input information received from a remote location. As used herein, a trip plan or selected plan is "generated" when an entire plan is created anew or an existing plan is adjusted based on, for example, recently received input information.

The first embedded system 136 may be configured to communicatively couple to a wireless communication system 126. The wireless communication system 126 includes an antenna 166 and associated circuitry that enables wireless communications with global positioning system (GPS) satellites 162, a remote (dispatch) location 114, and/or a cell tower 164. For example, first embedded system 136 may include a port (not shown) that engages a respective connector that communicatively couples the one or more processors 158 and/or memory 160 to the wireless communication system 126. Alternatively, the first embedded system 136 may include the wireless communication system 126. The wireless communication system 126 may also include a receiver and a transmitter, or a transceiver that performs both receiving and transmitting functions.

Optionally, the first embedded system 136 is configured to communicatively couple to or includes a locator device 124. The locator device 124 is configured to determine a location of the vehicle system 102 on the route 104. The locator device 124 may be a global positioning system (GPS) receiver. In such embodiments, one or more components of the locator device may be shared with the wireless communication system 126. Alternatively, the locator device 124 may include a system of sensors including wayside devices (e.g., including radio frequency automatic equipment identification (RF AEI) tags), video or image acquisition devices, or the like. The locator device 124 may provide a location parameter to the one or more processors 158, where the location parameter is associated with a current location of the vehicle system 102. The location parameter may be communicated to the one or more processors 158 periodically or upon receiving a request. The one or more processors 158 may use the location of the vehicle system 102 to determine the proximity of the vehicle system 102 to one or more segments of the trip, such as the upcoming segments.

Also shown, the second embedded system 137 includes one or more processors 138 and memory 140. Optionally, the second embedded system 137 is configured to communicatively couple to multiple sensors 116, 132. For example, the second embedded system 137 may include ports (not shown) that engage respective connectors that are operably coupled to the sensors 116, 132. Alternatively, the second embedded system 137 may include the sensors 116, 132.

The multiple sensors are configured to monitor operating conditions of the vehicle system 102 during movement of the vehicle system 102 along the route 104. The multiple sensors may monitor data that is communicated to the one or more processors 138 of second embedded system 137 for processing and analyzing the data. For example, the sensor 116 may be a speed sensor 116 that is disposed on the vehicle system 102. In the illustrated embodiment, the speed sensors 116 are located on or near the trucks 118. Each speed sensor 116 is configured to monitor a speed of the vehicle system 102 as the vehicle system 102 traverses the route 104. The speed sensor 116 may be a speedometer, a vehicle speed sensor (VSS), or the like. The speed sensor 116 may provide a speed parameter to the one or more processors 138, where the speed parameter is associated with a current speed of the vehicle system 102 or, more specifically, a current speed of the system vehicle 108, 110 to which the sensor is attached. The speed parameter may be communicated to the one or more processors 138 periodically, such as once every second or every two seconds, or upon receiving a request for the speed parameter. In some embodiments, a speed of the vehicle system or a speed of a system vehicle may be calculated using GPS to determine a distance traveled within a designated period of time.

The sensors 132 may measure other operating conditions or parameters of the vehicle system 102 during the trip (e.g., besides speed and location). The sensors 132 may include throttle and brake position sensors that monitor the positions of manually-operated throttle and brake controls, respectively, and communicate control signals to the respective propulsion and braking subsystems. The sensors 132 may also include sensors that monitor power output by the motors of the propulsion subsystem and the brakes of the braking subsystem to determine the current tractive and braking efforts of the vehicle system 102.

Furthermore, the sensors 132 may include string potentiometers (referred to herein as string pots) between at least some of the system vehicles 108, 110 of the vehicle system 102, such as on or proximate to the couplers 123. The string pots may monitor a relative distance and/or a longitudinal force between two vehicles. For example, the couplers 123 between two vehicles may allow for some free movement or slack of one of the vehicles before the force is exerted on the other vehicle. As one vehicle moves, longitudinal compression and tension forces shorten and lengthen the distance between the two vehicles like a spring. The string pots are used to monitor the slack between the vehicles of the vehicle system 102.

The above represents a short list of possible sensors that may be on the vehicle system 102 and used by the second embedded system 137 (or the control system 100 more generally), and it is recognized that the second embedded system 137 and/or the control system 100 may include more sensors, fewer sensors, and/or different sensors.

In an embodiment, the control system 100 includes a vehicle characterization element 134 that provides information about the vehicle system 102. The vehicle characterization element 134 provides information about the make-up of the vehicle system 102, which may be referred to as "makeup data." The makeup data may include the type of vehicles 110 (for example, the manufacturer, the product number, the materials, etc.), the number of vehicles 110, the weight of vehicles 110, whether the vehicles 110 are consistent (meaning relatively identical in weight and distribution throughout the length of the vehicle system 102) or inconsistent, the type and weight of cargo, the total weight of the vehicle system 102, the number of propulsion-generating vehicles 108, the position and arrangement of propulsion-generating vehicles 108 relative to the vehicles 110, the type of propulsion-generating vehicles 108 (including the manufacturer, the product number, power output capabilities, available notch settings, fuel usage rates, etc.), the number and types of couplers (or couplings), qualities of the couplers (or couplings) (e.g., a displacement/force model of the coupler or coupling), and the like. The vehicle characterization element 134 may be a database stored in an electronic storage device, or memory. The information in the vehicle characterization element 134 may be input using an input/output (I/O) device (referred to as a user interface device) by an operator, may be automatically uploaded, or may be received remotely via the communication system 126. The source for at least some of the information in the vehicle characterization element 134 may be a vehicle manifest, a log, or the like.

The control system 100 further includes a trip characterization element 130. The trip characterization element 130 is configured to provide information about the trip of the vehicle system 102 along the route 104. This information may also be referred to as "route data." The route data may include route characteristics, designated locations, designated stopping locations, schedule times, meet-up events, directions along the route 104, and the like. The route data may include a grade profile that indicates the grade of the route as a function of location or time, elevation slow warnings, environmental conditions (e.g., rain and snow), and curvature information. The designated locations may include the locations of wayside devices, passing loops, re-fueling stations, passenger, crew, and/or cargo changing stations, and the starting and destination locations for the trip. At least some of the designated locations may be designated stopping locations where the vehicle system 102 is scheduled to come to a complete stop for a period of time. For example, a passenger changing station may be a designated stopping location, while a wayside device may be a designated location that is not a stopping location. The wayside device may be used to check on the on-time status of the vehicle system 102 by comparing the actual time at which the vehicle system 102 passes the designated wayside device along the route 104 to a projected time for the vehicle system 102 to pass the wayside device according to the trip plan.

The trip information concerning schedule times may include departure times and arrival times for the overall trip, times for reaching designated locations, and/or arrival times, break times (e.g., the time that the vehicle system 102 is stopped), and departure times at various designated stopping locations during the trip. The meet-up events includes locations of passing loops and timing information for passing, or getting passed by, another vehicle system on the same route. The directions along the route 104 are directions used to traverse the route 104 to reach the destination or arrival location. The directions may be updated to provide a path around a congested area or a construction or maintenance area of the route. The trip characterization element 130 may be a database stored in an electronic storage device, or memory. The information in the trip characterization element 130 may be input via the user interface device by an operator, may be automatically uploaded, or may be received remotely via the communication system 126. The source for at least some of the information in the trip characterization element 130 may be a trip manifest, a log, or the like.

The first embedded system 136 is a hardware (with optional software) system that is communicatively coupled to or includes the trip characterization element 130 and the vehicle characterization element 134. The first embedded system 136 may also be communicatively coupled to the second embedded system 137 and/or individual components of the second embedded system 137, such as the sensors 116, 132, 123. The one or more processors 158 receives input information from components of the control system 100 and/or from remote locations, analyzes the received input information, and generates operational settings for the vehicle system 102 to control the movements of the vehicle system 102. The operational settings may be contained in a trip plan. The one or more processors 158 may have access to, or receives information from, the speed sensor 116, the locator device 124, the vehicle characterization element 134, the trip characterization element 130, and at least some of the other sensors 132 on the vehicle system 102. The first embedded system 136 may be a device that includes a housing with the one or more processors 158 therein (e.g., within a housing). At least one algorithm operates within the one or more processors 158. For example, the one or more processors 158 may operate according to one or more algorithms to generate a trip plan.

By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. Memory, such as the memory 140, 160, can include a tangible, non-transitory computer-readable storage medium that stores data on a temporary or permanent basis for use by the one or more processors. The memory may include one or more volatile and/or non-volatile memory devices, such as random access memory (RAM), static random access memory (SRAM), dynamic RAM (DRAM), another type of RAM, read only memory (ROM), flash memory, magnetic storage devices (e.g., hard discs, floppy discs, or magnetic tapes), optical discs, and the like.

In an embodiment, using the information received from the speed sensor 116, the locator device 124, the vehicle characterization element 134, and trip characterization element 130, the first embedded system 136 is configured to designate one or more operational settings for the vehicle system 102 as a function of time and/or distance along the route 104 during a trip. The one or more operational settings are designated to drive or control the movements of the vehicle system 102 during the trip toward achievement of one or more objectives for the trip.

The operational settings may be one or more of speeds, throttle settings, brake settings, or accelerations for the vehicle system 102 to implement during the trip. Optionally, the one or more processors 138 may be configured to communicate at least some of the operational settings designated by the trip plan or the selected plan. The control signal may be directed to the propulsion subsystem, the braking subsystem, or a user interface device of the vehicle system 102. For example, the control signal may be directed to the propulsion subsystem and may include notch throttle settings of a traction motor for the propulsion subsystem to implement autonomously upon receipt of the control signal. In another example, the control signal may be directed to a user interface device that displays and/or otherwise presents information to a human operator of the vehicle system 102. The control signal to the user interface device may include throttle settings for a throttle that controls the propulsion subsystem, for example. The control signal may also include data for displaying the throttle settings visually on a display of the user interface device and/or for alerting the operator audibly using a speaker of the user interface device. The throttle settings optionally may be presented as a suggestion to the operator, for the operator to decide whether or not to implement the suggested throttle settings.

At least one technical effect of various examples of the inventive subject matter described herein includes reducing the likelihood (or risk) of damage to couplers that interconnect the system vehicles while, optionally, attaining other objectives (e.g., fuel consumption, emissions, trip duration, etc.). Another technical effect may include improving performance of the vehicle system relative to a previously prepared trip plan. Another technical effect may include automatically controlling the vehicle system based on real-time data. Another technical effect may include an increased amount of automatic control time in which the human operator of the vehicle system does not manually control the vehicle system.

Figure 2:
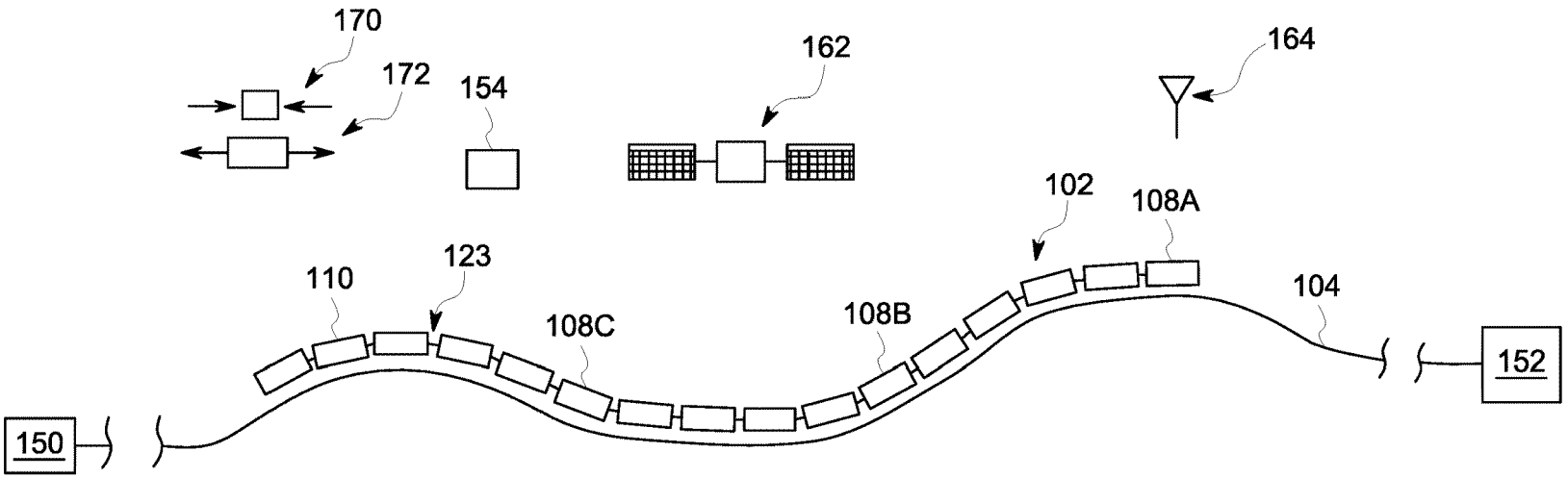
FIG. 2 is an illustration of a vehicle system traveling along a route in accordance with an embodiment.

FIG. 2 is an illustration of the vehicle system 102 traveling along the route 104 in accordance with an embodiment. The vehicle system 102 includes propulsion-generating vehicles 108A, 108B, 108C and thirteen (13) non-propulsion-generating vehicles 110. At least one of the propulsion-generating vehicles 108A, 108B, 108C includes the control system 100 (FIG. 1). The system vehicles 108A, 108B, 108C, and 110 are operatively coupled to one another through couplings 123. In the illustrated embodiment, the couplings 123 are physical connections and, as such, are hereinafter referred to as couplers 123. It should be understood, however, that some embodiments may include non-physical couplings (e.g., magnetic couplings).

The route 104 extends from a starting location 150 to a final destination location 152. The vehicle system 102 starts a trip along the route 104 at the starting location 150 and completes the trip at the final destination location 152. For example, the starting location 150 may be at or near a port, and the final destination location 152 may be at or near a mine, such as when the vehicle system 102 is set to travel from the port to the mine to receive a load of cargo at the mine to be transported back to the port. The trip may be, for example, tens, hundreds, or thousands of kilometers (or miles). A trip duration that is measured from the starting location 150 to the destination location 152 may be minutes or hours (e.g., 6 hours, 8 hours, 10 hours, 12 hours, or more). In some embodiments, a trip represents the journey between a point at which the vehicle system begins moving and a point at which the vehicle system is intended to stop moving and remain stopped to, for example, load or unload. In some embodiments, the trip includes all of the travel that a vehicle system 102 accomplishes in a single day.

The vehicle system 102 may communicate wirelessly with an off-board system 154, the GPS satellites 162, and/or cell towers 164. Prior to the vehicle system 102 departing for the trip and/or as the vehicle system 102 moves along the route 104, the vehicle system 102 may be configured to communicate with the off-board system 154. The off-board system 154 may be configured to receive a request for trip data from the vehicle system 102, interpret and process the request, and transmit input information back to the vehicle system 102 in a response. The input information (or trip data) may include trip information, vehicle information (or vehicle data), system makeup information (or makeup data), track information (or route data), and the like that may be used by the vehicle system 102 to generate a trip plan. As described above, the trip plan may be generated by the first embedded system 136 (FIG. 1). In other embodiments, the trip plan is generated by the control system generally using, for example, one or more embedded systems. Yet in other embodiments, the trip plan may be generated by the off-board system 154. Prior to the vehicle system 102 departing for the trip, the vehicle system 102 may also communicate with the GPS satellites 162 and/or the cell towers 164.

Vehicle information (or vehicle data) includes vehicle makeup information of the vehicle system 102, such as model numbers, manufacturers, horsepower, number of vehicles, vehicle weight, and the like, and cargo being carried by the vehicle system 102, such as type and amount of cargo carried. Trip information includes information about the upcoming trip, such as starting and ending locations, station information, restriction information (such as identification of work zones along the trip and associated speed/throttle limitations), and/or operating mode information (such identification of speed limits and slow orders along the trip and associated speed/throttle limitations). Route data includes information about the route (e.g., the track 104) along the trip, such as locations of damaged sections, sections under repair or construction, the curvature and/or grade of the route, global positioning system (GPS) coordinates of the trip, weather reports of weather experienced or to be experienced along the trip, and the like. The input information may be communicated to the vehicle system 102 prior to the vehicle system 102 departing from the starting location 150. The input information may also be communicated to the vehicle system 102 after the vehicle system 102 has departed from the starting location 150.

As the vehicle system 102 moves along the route 104, the vehicle system 102 may communicate with other wireless communication systems. For example, the vehicle system 102 may communicate with the GPS satellites 162 and/or the cell towers 164. The GPS satellites 162 may provide location information, such as latitude and longitude coordinates, that can be used to identify the location of the vehicle system 102 along the route 104. The GPS satellites 162 may also provide time information. For instance, the GPS satellites may communicate a present time to the vehicle system 102 that is expressed in a predetermined time standard (e.g., UTC). The cell towers may provide location information and/or time information. For example, the cell towers may communicate the present time based on the predetermined time standard or based on a regional time standard of the geographical region in which the vehicle system 102 is presently located. The cell towers may also provide location information that can be used to identify where the vehicle system 102 is located within the geographical region. In some embodiments, the vehicle system 102 may uses information from GPS satellites and information from cell towers.

As used in the detailed description and the claims, a trip plan may be generated before or after departure. During the trip, one or more new trip plans may be generated, such as after a trial plan is selected to improve one or more system-handling metrics. When a new trip plan is implemented based on a selected plan, the new trip plan becomes the current trip plan. For example, a new trip plan may be, numerically, the tenth trip plan generated by the vehicle system 102 during the trip between the starting location 150 and the final destination location 152.

As the vehicle system 102 moves along the route 104, the couplers 123 exhibit or cause rope forces. The rope forces include compression (or compressing) forces 170 and expansion (or expanding) forces 172. The rope forces may include other forces at the couplers 123. Due to a number of variables, the couplers 123 of the vehicle system 102 may exhibit different forces. Such variable include a grade of the route 104 that the adjacent system vehicles joined by the coupler 123 are traveling along, the type of coupler 123, the weights of the adjacent system vehicles, the weights of the other system vehicles in the vehicle system 102, acceleration (or deceleration) of the propulsion-generating vehicles 108, types of braking system, and the position of the adjacent system vehicle within the vehicle system 102.

Embodiments may use one or more processes (e.g., one or more algorithms) to identify a change in operational settings that will improve one or more system-handling metrics. With respect to a train, the one or more processes may identify the notch settings of one or more locomotives and the brake settings of the system vehicles to improve one or more of the system-handling metrics. As described above, non-limiting examples of system-handling metrics may include (a) relative acceleration between the system vehicles or groups of the system vehicles along the upcoming segment; (b) relative speed between the system vehicles or groups of the system vehicles along the upcoming segment; (c) relative momentum between the system vehicles or groups of the system vehicles along the upcoming segment; (d) relative displacement between the system vehicles or groups of the system vehicles along the upcoming segment; (e) difference between relative displacement and steady state displacement between the system vehicles or groups of the system vehicles; (f) difference between estimated dynamic force and steady state force between the system vehicles or groups of the system vehicles; (g) a time derivative of forces between the system vehicles or groups of the system vehicles; (h) a product between forces and time derivative of force between the system vehicles or groups of the system vehicles; (i) coupler forces between the system vehicles if couplers physically connect the adjacent system vehicles; (j) rope forces (e.g., steady state forces) between the system vehicles; (k) a function of the coupler forces and/or the rope forces (e.g., maximum of the coupler and/or rope forces over all of the system vehicles); or (l) a function that includes one or all of the above.

With respect to trains, the processes may be based on equations that represent the train movement dynamics through the track and that represent the internal dynamics of movement between vehicles (e.g., locomotives or rail vehicles) or groups of vehicles of the train. To this end, the processes may use inputs that are based on train makeup, such as characteristics of the locomotives and their position within the train, a number of vehicles, a train length or vehicle lengths, a train weight or vehicle weights, or coupler types (e.g., draft gear devices or end of car cushioning devices). Inputs may also be based on track characteristics (e.g., track elevation, grade profile, and/or curvature of the track). Embodiments may also use other parameters, such as average speed of the train and a time or a distance to complete the given distance or to complete the trip within the time horizon. Additional constraints, either soft or hard, can be used by the processes. For example, constraints may dictate maximum and minimum forces for a coupler (or group of couplers), maximum tractive effort and braking effort of each locomotive or group of locomotives, and maximum or minimum displacements for each coupler or a group of couplers.

Figure 3:
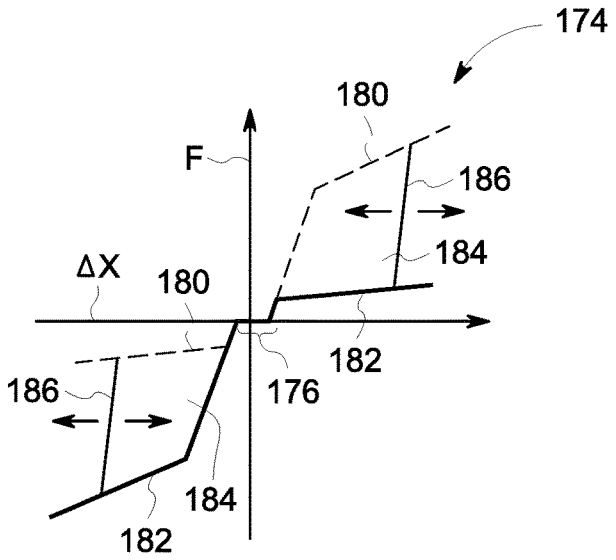
FIG. 3 illustrates a relationship between displacement and coupler force that is exhibited by a coupler that joins adjacent system vehicles of the vehicle system.

FIG. 3 illustrates a coupler displacement ($\Delta X$) and force (F) graph or model 174. The graph 174 is representative of the coupler forces exhibited or exerted by a single coupler 123 as a function of the displacement of the coupler 123 between adjacent system vehicles and a rate of displacement. The coupler forces may also be a function of when the rate of displacement transitions from a positive rate of displacement to a negative rate of displacement or vice versa. The coupler forces may be characterized as forces exerted by the coupler on the respective vehicle or vehicles. It is noted that FIG. 3 illustrates only one example of the coupler forces exhibited by the coupler 123. Other embodiments may utilize different types of couplers. For example, the couplers 123 may include draft gear devices and/or end of car cushioning devices. Each of these types may have different characteristics that change the coupler displacement ($\Delta X$) and force (F) graph.

The displacement (ΔX) is represented by the horizontal axis, and the force (F) is represented by the vertical axis. To the right of the vertical axis, the displacement is positive, which means the coupler 123 is in an expanded state. To the left of the vertical axis, the displacement is negative, which means the coupler 123 is in a compressed state. The graph 174 includes a dashed line 180, which represents a maximum force exhibited by the coupler 123 as the displacement of the coupler 123 is increasing. In other words, when the coupler 123 is increasing in length, the force exhibited by the coupler 123 for resisting expansion may move along or near the dashed line 180. The solid line 182 represents a minimum force exhibited by the coupler 123 as the displacement of the coupler 123 is decreasing. In other words, when the length of the coupler 123 is decreasing, the force exhibited by the coupler 123 for resisting compression may move along or near the solid line 182. Also shown, the forces for expanding or compressing the coupler 123 may be essentially zero at a "dead zone" 176 in which the coupler 123 is in a substantially non-expanded or in a substantially non-compressed state.

When the rate of displacement changes from positive-to-negative or from negative-to-positive, the force of the coupler transitions through a locked region 184 along a locked slope line 186. This transition is based on operation of the vehicle system or forces experienced by the vehicle system (e.g., an increase or decrease in tractive effort or change in grade of the route). As indicated by the arrows on opposite sides of the locked slope line 186, the locked slope line 186 may occur at different displacements. While transitioning between the limits 180, 182 in the locked region 184, the force of the coupler moves essentially along the locked slope line 186, even when the rate of displacement changes signs while the force of the coupler is on the locked slope line 186. For example, the force could be moving through the locked region 184 along the locked slope line 186 in a first direction. If the rate of displacement changes (e.g., from positive-to-negative), the force then moves through the locked region 184 along the same locked slope line 186 in an opposite second direction.

The slopes of the dashed and solid lines 180, 182 are proportional to corresponding spring constants of the coupler 123 outside the dead zone 176. As illustrated in FIG. 3, the force resisting compression may be different based on whether the coupler 123 is in an expanded state or in a compressed state. Likewise, the force resisting expansion may be different based on whether the coupler 123 is in an expanded state or in a compressed state. Moreover, the spring constant may be different based on whether the coupler 123 is in an expanded state or compressed state and whether the coupler 123 is expanding or compressing.

As used in various embodiments, the change in force as the displacement changes (i.e., slope of line 186) may be a constant, locked gain $K_L$, as the coupler 123 moves either in reverse or forward. The maximum and minimum forces do not clear the boundaries defined by the limits 180, 182. For example, the maximum force, when the displacement is positive, does not exceed the limit 180. The minimum force, when the displacement is positive, does not fall below 182. Likewise, the maximum force when the displacement is negative does not exceed the limit 180, and the minimum force when the displacement is negative does not fall below 182. The slope discontinuities and large range of slopes (stiff system of Ordinary Differential Equations (ODE)) may lead to come challenges (e.g., accuracy, computational efficiency, stability, etc). However, various methods, including but not limited to non-stiff ODE solvers, stiff-ODE solvers (e.g. Adams, Runge-Kutta, etc.) and/or modification of the discontinuities to make the solvers more efficient, can be used to solve stiff systems. By simulating the displacement and forces, the model can be implemented and used for real-time control.

The forces experienced by a system vehicle may be represented by the following equation, which may also be referred to as the rope model:

$$m_i\ddot{x}=F_i^{vehicle}+F_i-F_{i-1}$$

where $m_i$ is the mass of a system vehicle (e.g., rail car) i; $\ddot{x}$ is the acceleration of the system vehicle; $F_i^{vehicle}$ is the resultant of forces applied to a system vehicle (e.g., engine thrust, gravity, and drag); $F_i$ is the force exerted by a coupler i on the system vehicle; and $F_{i-1}$ is the force exerted by another coupler i−1. The couplers i and i−1 are connected to the system vehicle at opposite ends of the system vehicle.

A matrix based on the above equation may be represented as follows:

$$M\ddot{x}=f^{vehicle}-P_n f(\Delta x,\Delta\dot{x}),$$

where $P_n\in\mathbb{R}^{n\times n-1}$ is a differences matrix where $p_{i,i}=1$, $p_{i-1,i}=-1$ and $p_{i,j}=0$ otherwise. For example:

$$P_4=\begin{bmatrix}1 & 0 & 0\\ -1 & 1 & 0\\ 0 & -1 & 1\\ 0 & 0 & -1\end{bmatrix}$$

$f^{vehicle}\in\mathbb{R}^n$ is the vector of forces applied to each system vehicle, $f\in\mathbb{R}^{n-1}$ is the vector of forces, which is one less because we have n−1 couplers. The coupler force is a function of the relative displacements (Δx) and speeds ($\Delta\dot{x}$) that it is submitted to. M is the diagonal matrix of vehicle masses:

$$M=\begin{bmatrix}m_1 & 0 & \dots & 0\\ 0 & m_2 & \dots & 0\\ 0 & \vdots & \ddots & \vdots\\ 0 & 0 & \dots & m_n\end{bmatrix}$$

The differential equation for $M\ddot{x}$ may be referred to as a rigorous vehicle motion model and be used to calculate various metrics of the vehicle system during operation based on the external forces exerted on or by each vehicle ($F_i^{vehicle}$ for each of the system vehicles). More specifically, Δx and $\Delta\dot{x}$ relative displacements and relative speeds, respectively. and $\Delta\ddot{x}$ may also be calculated and is a relative acceleration. In some cases, it may be assumed that f(Δx, $\Delta\dot{x}$) is only dependent on the relative displacements and relative speeds (e.g., not on total vehicle speed or knuckle angle of the coupler). In some applications, the parcel of $f^{ext}$ due to grade and drag may be computed based on a nominal position of the system vehicle when compared to the head of the train. However, it is understood that the actual position of each system vehicle may change depending on the difference between the expected position of the system vehicle and the amount of extra displacement due to, for example, slack action. Grade force may also change. In some applications, drag effects may be considered the same for all system vehicles. In other applications, however, the drag effects may not be considered the same.

Figure 4:
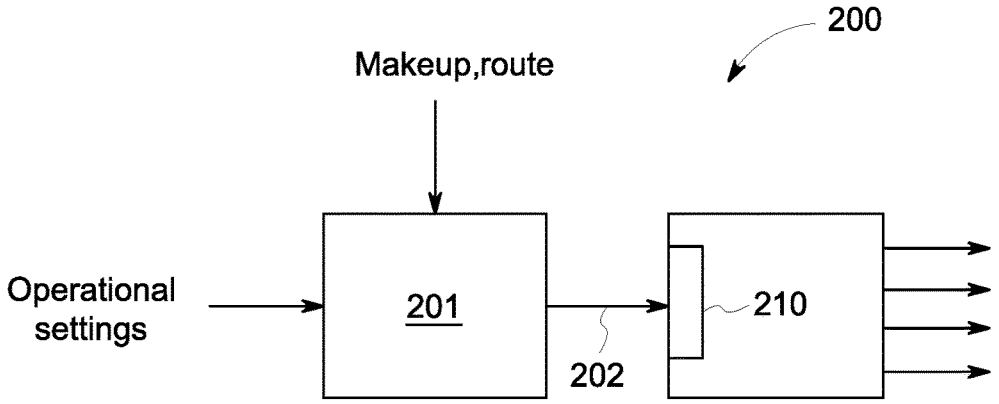
FIG. 4 is a schematic diagram of a vehicle-motion model that may be used by the control system of FIG. 1.

FIG. 4 is a block diagram of a vehicle-motion model 200 that may be used by the control system 100 (FIG. 1). In some embodiments, the vehicle-motion model 200 may be used to illustrate the evolution of different states (e.g., positions and speeds of system vehicles) over time. The vehicle-motion model 200 may include the equations provided above. In some embodiments, the vehicle-motion model 200 may be used to estimate (or observe) a system-handling metric. In some embodiments, the vehicle-motion model 200 may be configured to execute a plurality of simulations using different operational settings (e.g., notch settings, brake settings, and/or different timings of notch or brake settings) or different states.

As shown, an input generator 201 generates input data 202. The input data 202 may be based on, for example, the operational settings of the vehicle system, makeup data, and route data. For example, the input data 202 may be based on notch settings of the different propulsion-generating vehicles and/or brake settings of the system vehicles. The input data 202 may also be based on, for example, the mass of the system vehicles, the acceleration of the vehicle system, and resultant forces on the system vehicle, such as engine thrust, gravity, and drag. The input generator 201 may make calculations and package the input data 202 in a designated form. For example, the input generator 201 may use physics to determine rope forces over time and package the rope forces over time as the input data 202. It should be understood, however, that the input data 202 may include other data.

The input data 202 is provided to the vehicle-motion model 200. The input data 202 may be determined or calculated by the different operational settings. The vehicle-motion model 200 may use an algorithm that includes, for example, the vehicle motion model equation and execute the algorithm using the input data 202. The algorithm may output various system-handling metrics or data that may be used to calculate the system-handling metrics. For example, the vehicle-motion model 200 may output (a) relative accelerations between system vehicles or groups of system vehicles; (b) relative speeds between system vehicles or groups of system vehicles; (c) relative displacements between system vehicles or groups of system vehicles; (d) forces exhibited by the couplers (e.g., rope forces, dynamic forces); or (e) unsaturated coupler forces.

In some cases, each simulation performed by the vehicle-motion model 200 may be considered a trial plan in which different trial plans have different operational settings and/or different timings of the operational settings. These operational settings may be used to determine the input data 202 for the trial plan. Each trial plan, after being executed by the vehicle-motion model 200, may provide the system-handling metrics for the trial plan. Embodiments may analyze the system-handling metrics provided by each of the trial plans to identify a trial plan that improves one or more of the system-handling metrics. In some cases, embodiments may analyze the system-handling metrics provided by each of the trial plans to identify a trial plan that improves one or more of the system-handling metrics while achieving designated objectives.

To provide an example, embodiments may analyze the trial plans to identify the trial plan that has the highest fuel efficiency (or the least fuel consumption) for traveling a designated distance without exceeding maximum speed limits and in which at least one of the following is achieved: (i) the relative displacements between the different adjacent system vehicles do not exceed designated values; (ii) relative accelerations between system vehicles do not exceed designated values; (iii) relative speeds between system vehicles do not exceed designated values; and (iv) forces between system vehicles do not exceed designated values. For example, embodiments may identify five trial plans that satisfy (i), (ii), (iii) and (iv) above while traveling the designated distance and not exceeding the maximum speed limits. Among these five trial plans, embodiments may identify the trial plan that has the highest fuel efficiency or the least fuel consumption. Alternatively, embodiments may identify the trial plan that has the travels the most distance within a designated period of time. Yet in other embodiments, a plurality of factors or variables may be assessed in an objective function. Embodiments may then identify the trial plan that minimizes the objective function. The identified trial plan may be the selected plan as described above.

In some embodiments, the selected plan is not one of the trial plans but a plan that is generated based on the outputs provided by the vehicle-motion model when executing the trial plans. More specifically, the control system may analyze the outputs of the vehicle-motion model and determine a new plan that satisfies the constraints and achieves a desired objective.

In some embodiments, the plurality of different trial plans are iteratively or recursively generated such that performance of the vehicle system converges upon a desired outcome that is based upon an objective function. In such embodiments, the selected plan may be based on (1) a trial plan generated at a last iteration; (2) a trial plan generated at a second-to-last iteration; or (3) a constructed plan at an end of a recursive process. The iterative or recursion processes may be executed until a condition is satisfied. For example, the condition may be satisfied when the operational settings do not change from the trial plan of one iteration and the trial plan of a subsequent iteration. As another example, the condition may be satisfied when a value of a metric (e.g., fuel efficiency) passes a threshold value. The condition may also be the number of trial plans generated (e.g., 10 trial plans). The condition may also be a designated event or a forecasted event. When the trial plan causes the designated or forecasted event, the process may be stopped and the last trial plan may be used as the selected plan.

Optionally, the control system or the vehicle-motion model 200 may include a group selector 210 may divide the system vehicles 108, 110 into different groups (or lump the system vehicles 108, 110 into different groups). As described herein, the system vehicles 108, 110 may be grouped together to reduce the number of computations by the control system. The control system may effectively consider the groups as individual vehicles when executing the vehicle-motion model 200. For example, a vehicle system having 169 vehicles may be formed into twelve (12) groups in which adjacent groups are joined by a lumped coupler. Twelve groups may have eleven (11) lumped couplers, which is significantly less than the 168 couplers of the original vehicle system. For embodiments that lump couplers and vehicles together, the input data 202 may be generated for the groups and lumped couplers. For example, the input data 202 may include rope forces over time $f^R$ for each of the lumped couplers and may include the weights of the different groups. The weight of the group may be the sum of the weights of the individual vehicles. As such, the number of computations may be significantly reduced. In other embodiments, however, the vehicles are not grouped and the computations may be executed for each of the individual couplers.

Figure 5:
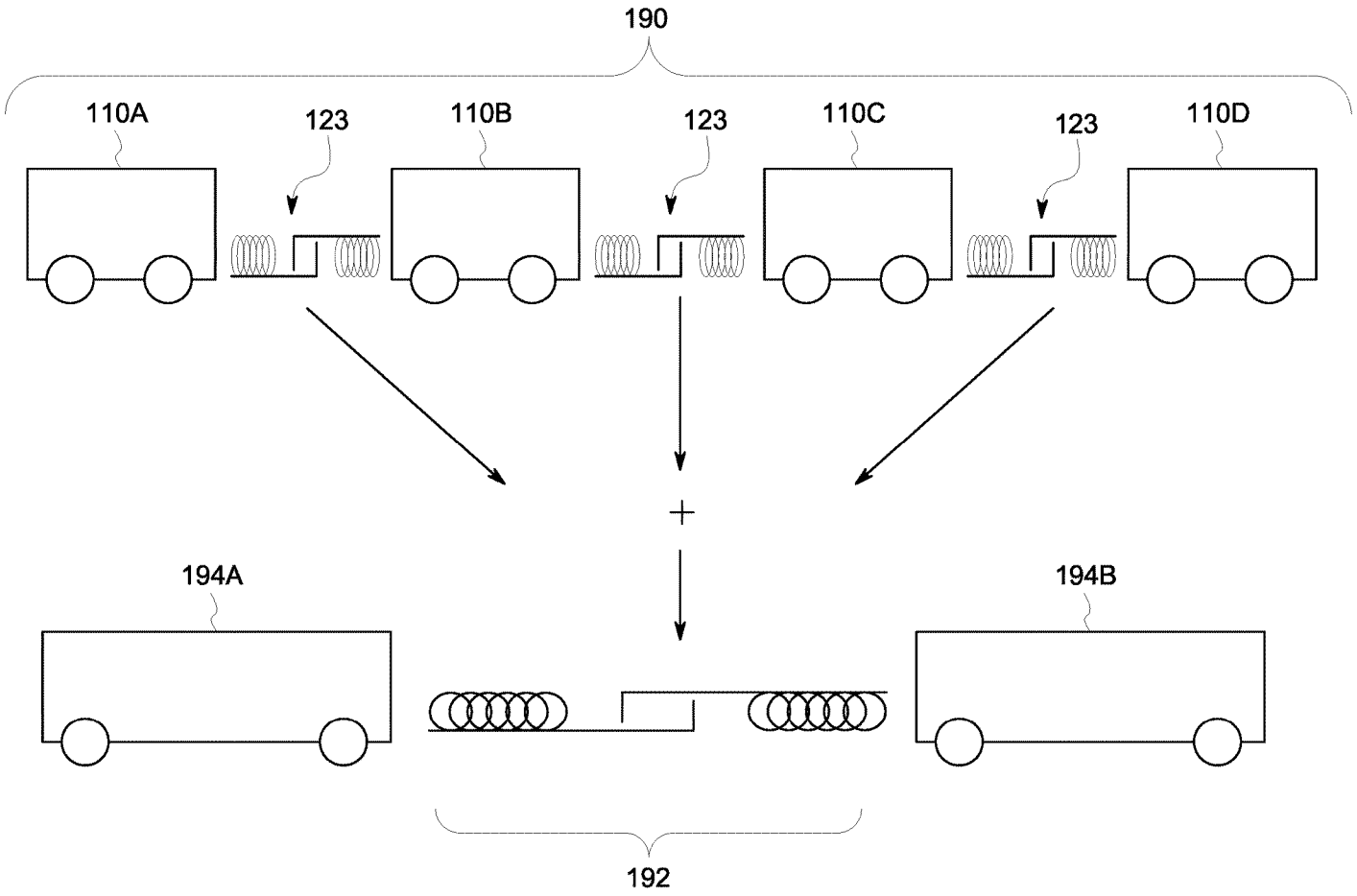
FIG. 5 illustrates how plural couplers that join adjacent system vehicles of the vehicle system can be lumped together in an embodiment.

FIG. 5 illustrates how system vehicles 110A-110D in a group 190 and couplers 123 that join the system vehicles 110A-110D in the group 190 can be lumped together for one or more embodiments. For embodiments that lump (or group) couplers and vehicles together, the vehicle-motion model 200 effectively assumes that the couplers 123 within a group 190 of system vehicles 110A-110D exhibit approximately the same forces. As described herein, the number of computations may be reduced by lumping the couplers 123 and system vehicles 110 and, consequently, a total time for computing a plan or executing a simulation may be reduced.

More specifically, the couplers 123 within the group 190 of system vehicles 110A-110D may be represented by a single "lumped coupler" (indicated as 192) within the vehicle-motion model 200. A coupler displacement/force model of the lumped coupler 192 that is used in the vehicle-motion model 200 may be similar to the coupler displacement/force model used for only one of the couplers 123. For example, a resulting stiffness of the lumped coupler 192 may be approximately equal to an inverse of the sum of the inverses of the individual stiffnesses of the couplers 123. The slacks of the couplers 123 may be summed to provide a lumped slack. Accordingly, for the embodiment shown in FIG. 5, the lumped coupler 192 may have a lesser stiffness and greater slack compared to the couplers 123.

In some applications, the couplers 123 within the group 190 of system vehicles 110A-110D may be of different types. For example, a coupler may be of type Draft Gear and the other may be of type End of Car Cushioning (EOCC). In this case, the computation of the curves of force versus displacement model of the group 190 is done, for every point of the curve, by summing the displacement value of every coupler at any given force coordinate. In other words, if each coupler j has a displacement curve $\Delta x_j(f)$, then the displacement curve of the lumped coupler 192 will be $\Delta x_{group}(f) = \Sigma_j \Delta x_j(f)$. The resulting locked stiffness of the lumped coupler 192 may be approximately equal to an inverse of the sum of the inverses of the individual locked stiffnesses of the couplers 123. Is some applications, the grouping of system vehicles containing different couplers may be avoided, and grouping is performed solely among cars connected by the same coupler type.

Similarly, the system vehicles 110A-110D within the group 190 may be represented by lumped vehicles 194A, 194B within the vehicle-motion model 200. For example, the weights of the system vehicles 110A, 110B in the group 190 may be combined and the lumped vehicle 194A may have the combined weight. The weights of the system vehicles 110C, 110D in the group 190 may be combined and the lumped vehicle 194B may have the combined weight. The lengths of the system vehicles 110A, 110B in the group 190 may be combined and the lumped vehicle 194A may have the combined length. The lengths of the system vehicles 110C, 110D in the group 190 may be combined and the lumped vehicle 194B may have the combined length. Accordingly, the computations of the vehicle-motion model 200 may be based on the combined characteristics of the system vehicles in a group and the combined characteristics of the couplers that join the system vehicles in the group.

For embodiments in which the vehicle-motion model 200 (FIG. 4) uses a coupler displacement/force model for a lumped coupler (group of couplers), the vehicle-motion model 200 may calculate the system-handling metrics of adjacent groups. For example, the vehicle-motion model 200 may determine the relative speeds of adjacent groups, the relative positions of adjacent groups (e.g., displacement), or the coupler and/or rope forces exhibited between different groups. The vehicle-motion model 200 may also determine the relative speeds of non-adjacent groups, the relative positions of non-adjacent groups, or the coupler and/or rope forces exhibited between non-adjacent groups. In other embodiments, however, the vehicle-motion model 200 does not lump the couplers together and, instead, determines the system-handling metrics between adjacent system vehicles. As described above, a plurality of trial plans may be executed and one of the trial plans that improves the system-handling metric(s) may be selected for modifying the current trip plan. As an example, embodiments may analyze the trial plans to identify the trial plan that reduces relative displacements and/or coupler forces between groups. Optionally, the selected plan is the last plan (or second-to-last plan) that is generated through an iterative or recursive process. In other embodiments, a new plan may be generated based on information provided by one or more of the trial plans.

Although FIG. 5 only shows the system vehicles 110, it is contemplated that the couplers of the system vehicles 108 (FIG. 1) may also be grouped with the couplers of other vehicles. In other words, a single group may lump the couplers between adjacent system vehicles 110, the couplers between a system vehicle 108 and an adjacent system vehicle 110, or the couplers between adjacent system vehicles 108. Alternatively, the system vehicles 108 may be considered individually. Alternatively, the system vehicles 108 may be grouped with one another and the system vehicles 110 may be in separate groups. Again, it should be understood that although some embodiments may lump couplers together and lump vehicles together to reduce the number of computations, other embodiments may not lump couplers together and lump vehicles together. In such instances, embodiments may consider only the characteristics of the individual couplers and of the individual vehicles.

Figure 6:
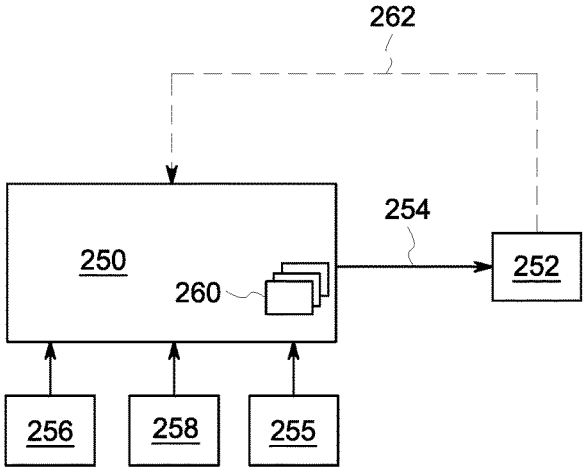
FIG. 6 is a schematic diagram that illustrates how the vehicle-motion model of FIG. 4 may be used to improve one or more system handling metrics in accordance with an embodiment.

FIG. 6 is a block diagram illustrating one method of controlling a vehicle system using a control system, such as the control system 100 (FIG. 1). The control system may be disposed on-board or disposed off-board. As shown, the diagram includes a plan generator 250 that is configured to generate a plan (e.g., trip plan, trial plan, or the like) that dictates or specifies operational settings of a vehicle system 252. The operational settings may specify, for example, at least one of tractive efforts or braking efforts of the vehicle system 252 along a route. The plan generator 250 may be part of, for example, a control system, such as the control system 100 (FIG. 1). In FIG. 6, the plan generator 250 appears to be off-board with respect to the vehicle system 252. It should be understood that the plan generator 250 may be onboard the vehicle system in some embodiments.

The plan generator 250 is configured to control movement of the vehicle system 252 along the route. The plan generator 250 may implement a model predictive control (MPC) process. The MPC process may iteratively or recursively determine operational settings for the vehicle system for a prediction horizon. The prediction horizon may be defined by time and/or distance and corresponds to an upcoming segment of the route. The MPC process may determine a solution to an objective function for the upcoming segment using a vehicle-motion model and designated constraints. The solution specifies the operational settings to be implemented by the vehicle system. As the operational settings of the solution are implemented by the vehicle system, the MPC process is repeated. Optionally, the MPC process may receive information (e.g., feedback information) from the vehicle system as the vehicle system moves along the route. Alternatively or in addition to the feedback information, the MPC process may receive new information for a portion of the upcoming segment that entered the prediction horizon. Optionally, the MPC process does not use feedback information and, instead, may use predetermined information, such as information from a trip plan. By repeatedly executing the MPC process, the vehicle system converges upon an optimal operation, as defined by the objective function, and continues to operate near an optimal operation.

The plan generator 250 communicates instructions 254 (or control signal) to the vehicle system 252 or, more specifically, the parts of the vehicle system 252 that control the operational settings. The instructions 254 are based on the solution determined by the MPC process and include information for controlling operation of the vehicle system 252. For example, the instructions 254 may include a schedule or sequence of operational settings (e.g., tractive settings, brake settings, etc.) for the upcoming segment. This schedule or sequence of operational settings constitutes a trip plan for the upcoming segment. In some embodiments, the instructions 254 may indicate how to deviate from a current trip plan. For example, the instructions 254 may only include the differences between a new plan (e.g., the solution to the objective function) and the present trip plan. More specifically, the instructions 254 may instruct the vehicle system 252 to change the tractive efforts of the current trip plan by X amount and/or change the braking efforts of the current trip plan by Y amount. With respect to a train, the instructions 254 may instruct the vehicle system 252 to change the notch settings of the current trip plan and/or change the brake settings of the current trip plan.

The instructions 254 are based on information that is provided to the plan generator 250 or stored with the control system and analysis performed by the plan generator 250. The information may include constraints 256, an objective function 258, and a vehicle-motion model 255, such as the vehicle-motion model 200. The vehicle-motion model 255 is configured to generate a plan 260 (e.g., trial plan or simulation) based on the constraints 256 and the objective function 258 for a designated horizon. The constraints 256 may limit certain parameters. For example, the constraints 256 may include speed limits for designated segments of the routes, fuel consumption limits, length of route, time of arrival at destination, maximum tractive efforts, or braking limits. The objective function 258 is a multi-variable function that is configured to provide a desired outcome, as selected by the control system or operator of the vehicle system, when applied to the vehicle-motion model 200. The objective function 258 may be characterized as a cost function, profit function, reward function, or the like. In some embodiments, the objective function 258 includes one or more metrics (or variables) that are to be improved. The metrics may be one or more of the system-handling metrics describe herein. For example, the objective function 258 may be a function of maximum coupler forces and/or maximum displacements of the couplers. The metrics of the objective function may not be system-handling metrics. For example, the metrics of the objective function may be fuel efficiency, fuel emissions, operational costs, trip time, etc. It should be understood that the objective function 258 may include one or more metrics that are also constraints 256. For example, the objective function 258 may be a function of fuel consumption or trip time.

In some embodiments, the constraints 256 may include the equations and/or algorithms that constitute the vehicle-motion model 255. In such embodiments, the instructions 254 include control actions, such as tractive settings and brake settings, and states over time. The states over time may include displacements between adjacent system vehicles, speeds of the different system vehicles, and forces experience or exhibited by the system vehicles and/or couplers.

Optionally, the vehicle system 252 may utilize a real-time control loop in which the vehicle system 252 is controlled, in part, based on feedback from the vehicle system 252. For example, the vehicle system 252 may communicate a reference signal 262. The plan generator 250 may use the reference signal 262 in developing trial plans (or simulations) and determining future instructions 254. The reference signal 262 may represent reference metric of the vehicle system 252. The reference metric may be one or more of the system-handling metrics described herein. For example, the reference metric may be a speed metric. As used herein, a speed metric may include at least one of: (a) an actual (or present) speed of one of the system vehicles; (b) an actual speed of a group of system vehicles; (c) a center-of-mass speed of one of the system vehicles; (d) a center-of-mass speed of the vehicle system; (e) a center-of-mass speed of a group of system vehicles; (f) a difference in speed between system vehicles; (g) a difference in speed between groups of system vehicles; (h) or a function of (a)-(g).

Accordingly, a control system, such as the control system 100, having the plan generator 250 may be configured to control the vehicle system 252 as the vehicle system moves along a route. In some embodiments, the vehicle system 252 is controlled in accordance with a current trip plan that dictates operational settings that provide at least one of tractive efforts and braking efforts of the vehicle system 252 along the route. As the vehicle system 252 is moving along the route, the plan generator 250 may generate a plurality of different trial plans (or simulations) 260 for an upcoming segment of the route. The trial plans may be based on, for example, predicted rope forces over time, dynamic forces, makeup data, and/or route data. These trial plans include potential operational settings for providing at least one of tractive efforts and braking efforts of the vehicle system along the route. The plan generator 250 may select one of the trial plans as a selected plan.

In some embodiments, the plurality of different trial plans 260 are iteratively or recursively generated such that performance of the vehicle system converges upon a desired outcome that is based upon an objective function. The selected plan may be based on the trial plan generated at a last iteration or the trial plan generated at a second to last iteration. Optionally, the plurality of different trial plans are iteratively generated until a condition is satisfied. Various conditions may be used. For example, the condition may be satisfied when the operational settings do not change from the trial plan of one iteration and the trial plan of a subsequent iteration. As another example, the condition may be satisfied when a value of a metric (e.g., fuel efficiency) passes a threshold value. The condition may also be the number of trial plans generated (e.g., 10 trial plans). The condition may also be a designated event or a forecasted event.

In other embodiments, each of the plurality of different trial plans generated by the plan generator may specify operational settings from a first position (e.g., kilometer marker 10) to a second position (e.g., kilometer marker 20). The selected plan may better improve, compared to at least one (or two) other trial plans, the one or more system-handling metrics. Yet in other embodiments, the selected plan is not any of the trial plans but is a function of at least one of the trial plans. For example, the selected plan may have a system-handling metric that is modified relative to the system-handling metric of one of the trial plans.

Optionally, the system-handling metrics may be based on the rope forces or dynamic forces exhibited by the couplers along the upcoming segment. In some embodiments, the selected plan may be configured to reduce, compared to the current trip plan, a risk of damage to the couplers that is caused by the rope forces or dynamic forces being excessive.

The above process may be repeated a plurality of times along the route. Each time the process is repeated, the vehicle system may be further along the route such that new information regarding the route (e.g., route data) and/or the trip plan is considered re-executing the process. Optionally, the new information may also include feedback information. As an example, the above process may be repeated along the route when at least one of: (a) a designated amount of time elapses (e.g., thirty seconds, one minute, two minutes, five minutes, or more); (b) a designated distance is traveled (e.g., one kilometer, two kilometers, three kilometers, or more); (c) a designated event occurs; or (d) a designated event is predicted through simulation. With respect to (c), the operator may request that the current trial plan be updated. As another example, the vehicle system may receive new information from an off-board location. As yet another example, the vehicle system may obtain a speed that is significantly different from the speed of the trial plan. When the designated event occurs, the above process is triggered so that the current trip plan may be updated. With respect to (d), a simulation for the upcoming segment may indicate that an excessive force (e.g., a damage or wear-causing force) will occur at a designated time or location along the route.

Optionally, when generating the trial plans or simulations, adjacent system vehicles of the vehicle system 252 may be lumped together and couplers may be lumped together as described herein. For instance, the system vehicles may be assigned to a plurality of groups in which the groups include a series of operatively coupled system vehicles. In particular embodiments, the rope forces between adjacent system vehicles in a common group may be assumed to be zero when generating the trial plans. In particular embodiments, the relative speeds between adjacent system vehicles in a common group may be assumed equal when generating the trial plans. In such embodiments, the system vehicles of a group may be identified as a single system vehicle by the vehicle-motion model.

A group of system vehicles includes at least two system vehicles. The different groups may have an equal or unequal number of vehicles. In particular embodiments, the groups may have at least 3 system vehicles, at least 5 system vehicles, at least 8 system vehicles, at least 10 system vehicles, at least 12 system vehicles, at least 15 system vehicles, or at least 20 system vehicles.

After obtaining the selected plan, the control system may communicate instructions to change at least one of the operational settings of the current trip plan based on the selected plan. For example, the plan generator 250 may send the instructions 254 to the vehicle system 252 that changes the current trip plan. In some embodiments, changing the at least one operational setting of the current trip plan based on the selected plan includes replacing a portion of the current trip plan that corresponds to the upcoming segment with the selected plan. In some cases, the selected plan may not differ from a current trip plan. In such embodiments, the operational settings may not be changed.

The upcoming segment (or horizon) may have a range of possible lengths. For example, the upcoming segment of the route may be, for example, at least one of: (a) at most twenty kilometers ahead of a leading end of the vehicle system at a present time; or (b) a distance ahead of the leading end of the vehicle system that is equal to at most thirty minutes of travel according to the current trip plan. In more particular embodiments, the upcoming segment of the route may be at least one of: (a) at most ten kilometers ahead of a leading end of the vehicle system at a present time; or (b) a distance ahead of the leading end of the vehicle system that is equal to at most fifteen minutes of travel according to the current trip plan. In other embodiments, the upcoming segment includes a remainder of the trip.

Optionally, a trip plan for a vehicle system moving along a route may be generate prior to the vehicle system embarking on the trip in a manner that is similar to the process described above. However, instead of generating trial plans as the vehicle system moves along the route, the plan generator may generate trial plans and select the selected plan prior to the vehicle system embarking on the trip. For example, the control system may include one or more processors that are configured to (a) generate a plurality of different trial plans for an upcoming segment of the route. The first upcoming segment may be the beginning of the route. The trial plans include potential operational settings of the vehicle system along the route. The one or more processors that are configured to (b) select one of the trial plans as a selected plan or generate the selected plan based on one or more of the trial plans. The selected plan is configured to improve one or more system-handling metrics as the vehicle system moves along the upcoming segment of the route.

After selecting the selected plan for the first upcoming segment, the plan generator may then simulate the trip for a subsequent upcoming segment. For example, the vehicle system (in the simulator) may begin to move along the first upcoming segment. The plan generator may analyze new information, such as the route data for the newly added portion of the route, and apply this new information to the known information (e.g., vehicle data) for generating trial plans of the second upcoming segment. The steps of (a) and (b) may be repeated a plurality of times along the route for different or overlapping upcoming segments until the trial plan is completed for the entire route or a designated portion of the route. In some aspects, (a)-(c) constitute a model predictive control (MPC) process.

Figure 7:
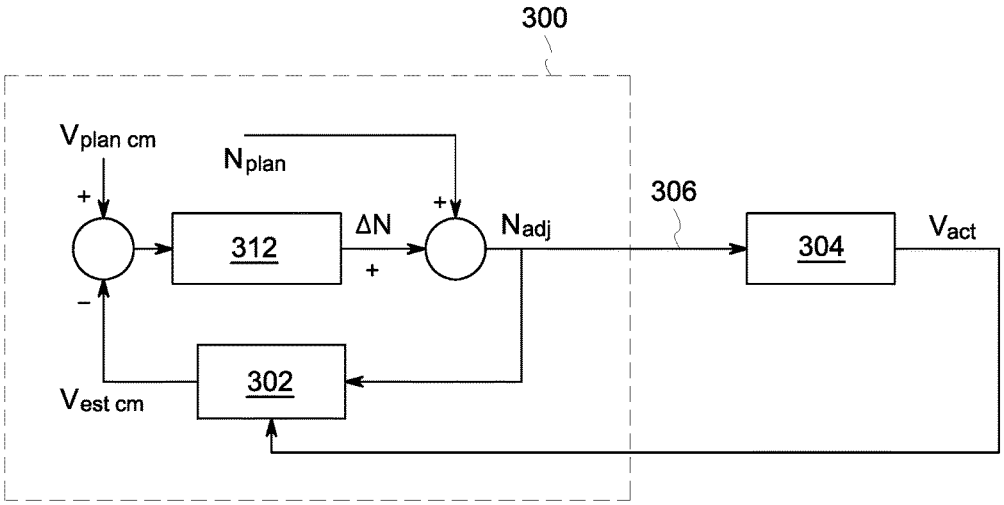
FIG. 7 is a schematic diagram that illustrates how the vehicle-motion model of FIG. 4 may be used to control a vehicle system in accordance with an embodiment.
Figure 8:
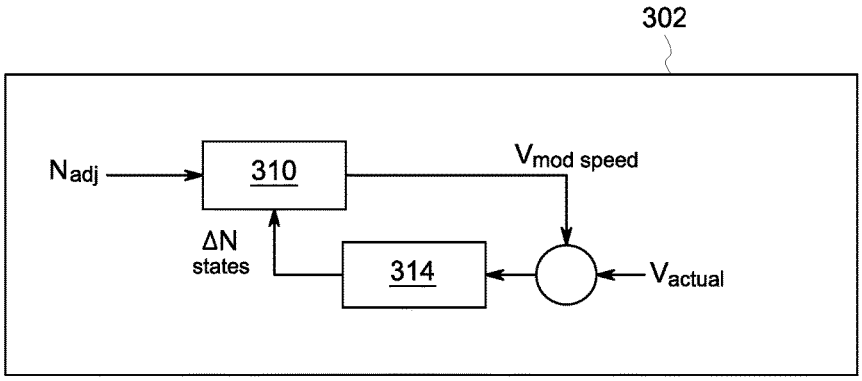
FIG. 8 is a schematic diagram of an observation module that may be used by a control system in FIG. 7.

FIG. 7 is a schematic diagram that illustrates how a control system 300 that includes an observer module 302 may be used to control a vehicle system 304. FIG. 7 also illustrates a method of controlling the vehicle system 304. The observer module 302, which is illustrated in greater detail in FIG. 8, includes a vehicle-motion model 310 that may be similar or identical to the vehicle-motion model 200 (FIG. 5). The observer module 302 is configured to determine (e.g., estimate) an observed metric based on the operational settings of the vehicle system 304 and, optionally, an operating system-handling metric of the vehicle system 304. The observed metric may then be compared to a reference metric of the same type. In certain embodiments, the reference metric is derived from a trip plan, although it is contemplated that the reference metric may be provided by other sources, including the operator of the vehicle system. If the two metrics differ, the control system 300 includes a regulator 312 that is configured to make adjustments or modifications to the planned operational settings based on the differences. For example, in the illustrated embodiment, the observer module 302 is configured to determine an estimated center-of-mass (CM) vehicle speed $V_{est\ cm}$ based on an actual speed $V_{act}$ of a system vehicle of the vehicle system 304. The estimated CM vehicle speed $V_{est\ cm}$ may then be compared to a planned CM vehicle speed $V_{plan\ cm}$. The differences between the two metrics may be used to determine how to change the operational settings of the vehicle system so that the performance of the vehicle system is closer to the performance dictated by the trip plan. In the above example, the observed metric is the estimated center-of-mass (CM) vehicle speed $V_{est\ cm}$ and the reference metric is the planned CM vehicle speed $V_{plan\ cm}$. It should be understood that other metrics may be used for the observed and reference metrics.

The vehicle system 304 includes a plurality of system vehicles that are operative coupled to each other through couplings (e.g., physical or non-physical couplings) that permit the adjacent system vehicles to move relative to one another. The system vehicles may have one or more propulsion-generating vehicles and one or more non-propulsion-generating vehicles. In some embodiments, the system vehicles may form a plurality of consists in which each consist has at least one propulsion-generating vehicle. The control system 300 may be disposed on-board the vehicle system 304 or disposed off-board the vehicle system 304.

As the vehicle system 304 moves along the route, the vehicle system 304 receives instructions 306 (e.g., a control signal) for controlling operation of the vehicle system. The instructions 306 include operational settings $N_{adj}$ for the system vehicles, such as the propulsion-generating vehicles. For example, in embodiments that control trains, the instructions 306 include operational settings $N_{adj}$ (e.g., notch settings and brake settings) for the different locomotives of the train. In the illustrated embodiment, the operational settings $N_{adj}$ are a function of planned operational settings $N_{plan}$, adjusted by the difference between a planned center-of-mass (CM) vehicle speed $V_{plan\ cm}$ and the observed speed $V_{est\ cm}$. The planned operational settings $N_{plan}$ and the planned CM vehicle speed $V_{plan\ cm}$ are dictated by a trip plan, such as the trip plans described herein, which dictate or specify operational settings as a function of time and/or location.

The following provides one example of how the vehicle system 304 may be controlled by using the observer module 302. As the vehicle system 304 is moving along the route, the control system 300 is configured to receive a system-handling metric of a first type of the vehicle system as the vehicle system moves along the route. In this example, the system-handling metric is the speed of the lead system vehicle $V_{act}$. The observer module 302 receives the system-handling metric $V_{act}$. vehicle-motion model The vehicle-motion model 310 may execute a simulation using the vehicle-motion model 310 in which the operational settings of the vehicle system that form part of the input data of the vehicle-motion model 310 are the operational settings $N_{adj}$ that are currently being implemented. With the operational settings known and the vehicle data and track data known, the input data may be provided to the vehicle-motion model 310. From the vehicle-motion model 310, a model speed $V_{mod\ speed}$ of the lead system vehicle is provided. Although the model speed $V_{mod\ speed}$ may also be referred to as an observed metric, the model speed $V_{mod\ speed}$ may be referred to as an estimated metric (or model metric) for clarity. The model speed $V_{mod\ speed}$ may be compared to the system-handling speed $V_{act}$. of the lead system vehicle. An error between the system-handling metric of the first type and the estimated metric of the same type may be computed. Based on this error, the states of the vehicle-motion model may be adjusted as a function of such error. The states of the vehicle-motion model may include, for example, relative speeds between the system vehicles or relative positions of the system vehicles. With respect to the example shown in FIG. 7, the differences between the model speed $V_{mod\ speed}$ and the actual speed $V_{act}$. of the lead system vehicle may be provided to a gain module 314. The gain module 314 may provide corrections to the states in the vehicle-motion model 310.

With the adjusted states of the vehicle-motion model 310, the estimated CM vehicle speed $V_{est\ cm}$ may be determined. and the estimated CM vehicle speed $V_{est\ cm}$ may be compared to the planned CM vehicle speed $V_{plan\ cm}$, which is the reference metric. The difference between the estimated CM vehicle speed $V_{est\ cm}$ and the planned CM vehicle speed $V_{plan\ cm}$ (or the error) may be provided to the speed regulator 312. The speed regulator 312 may determine changes to the operational settings $\Delta N$ so that the actual performance of the vehicle system 304 may be closer to the planned performance dictated by the current trip plan. These changes to the operational settings $\Delta N$ may be applied to the planned operational settings $N_{plan}$ to provide the adjusted operational settings $N_{adj}$. The adjusted operational settings $N_{adj}$ are the actual operational settings applied to the vehicle system 304 and provided to the observer module 302. The adjusted operational settings $N_{adj}$ may change the performance of the vehicle system so that the estimated CM speed will approach the planned CM speed.

The above process is repeated as the vehicle system moves along the route. For example, the above process may be repeated continuously until the vehicle system reaches its destination. Alternatively, the above process may be repeated until a designated event occurs. Although the error between the model speed $V_{mod\ speed}$ and the actual speed $V_{act}$ of the lead system may be relatively large during the first time. The error may gradually reduce through each subsequent process. After repeating the process multiple times, the performance of the vehicle system may improve. For example, the vehicle system may more closely follow the trip plan with fewer or less significant changes to the operational settings.

Accordingly, the control system 300 may be configured to receive system-handling metric of a first type (e.g., actual speed of a designated system vehicle) as the vehicle system moves along the route. Although the actual speed of the lead system vehicle was used in the above example, other embodiments may use the actual speed of a different system vehicle or of a group of system vehicles or may use a different system-handling metric. The control system 300 may then determine an observed speed metric of a second type (e.g., CM speed of the vehicle system) based on the actual speed metric and the vehicle-motion model 310. Optionally, in some embodiments, the system vehicles may be assigned to different groups (or lumped) to reduce the number of computations as described herein.

The control system 300 may then compare the observed metric of the second type to a reference metric of the second type. As such, the two metrics that are compared are of the same type. The control system 300 may then modify the operational settings of the vehicle system based on differences between the observed metric of the second type and the reference metric of the second type. The reference metric may be, for example, at least one of speed metrics of the system vehicles; accelerations of the system vehicles; steady state or dynamic forces; length of the train, internal energy in couplers; momentum transfer; relative separation of the system vehicles; or a function of one or more of the above.

In some embodiments, however, a feedback loop is not provided. Instead, the embodiment of FIGS. 7 and 8 may utilize an open loop scheme. In such embodiments, the operating system-handling metric is not used. More specifically, input data may be provided to the vehicle-motion model 310 that includes the current operational settings, makeup data, and route data. With this input data, the observed metric (e.g., the CM speed) may be estimated and compared to the reference metric. In such embodiments, the states are not changed based on an error between an operating system-handling metric (e.g., detected vehicle speed) and the model metric (e.g., vehicle speed outputted by the vehicle-motion model).

Figure 9:
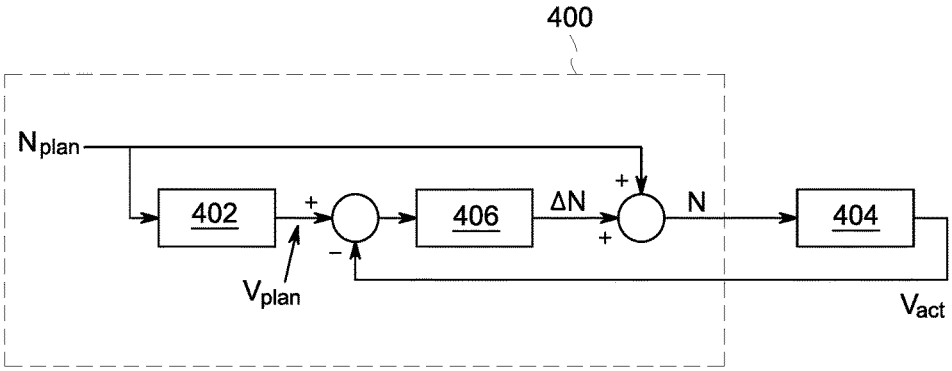
FIG. 9 is a schematic diagram that illustrates how the vehicle-motion model of FIG. 4 may be used to control a vehicle system in accordance with an embodiment.

FIG. 9 is a schematic diagram that illustrates how a control system 400 may use a vehicle-motion model 402 to control operation of a vehicle system 404. In the illustrated embodiment, the vehicle-motion model 402 is used to calculate a planned speed $V_{plan}$ of a designated system vehicle, such as the lead system vehicle. More specifically, the operational settings of the current trip plan $N_{plan}$ may be provided to the vehicle-motion model 402, which may provide sufficient information for determining the planned speed $V_{plan}$ of the lead system vehicle. The planned speed $V_{plan}$ and the actual speed $V_{act}$ may be compared to each other and the difference may be provided to a speed regulator 406. The speed regulator 406 may determine changes to the operational settings ΔN so the actual performance of the vehicle system 404 is changed to better approximate the performance dictated by the current trip plan. In other words, the operational settings ΔN that, when applied to the operational settings of the current trip plan $N_{plan}$, would cause the vehicle system to change its performance so that the actual speed $V_{act}$ approaches the planned speed $V_{plan}$.

Accordingly, in some embodiments, the control system 400 may determine a reference metric (e.g., planned speed metric of the vehicle system) based on operational settings of the current trip plan. The reference metric may be outputted by the vehicle-motion model. The control system 400 may then compare reference metric to a system-handling metric (e.g., vehicle speed of lead vehicle) of the vehicle system. The reference metric and the system-handling metric may be essentially the same type of metric. As used herein, two metrics are essentially the same type if the two metrics are always approximately equal. As an example, the system-handling metric may be the speed of the lead vehicle, and the reference metric may be the speed of the vehicle that is immediately adjacent to the lead vehicle (e.g., the second vehicle). The control system 400 may then modify the operational settings of the vehicle system based on differences between the reference metric and the system-handling metric.

Figure 10:
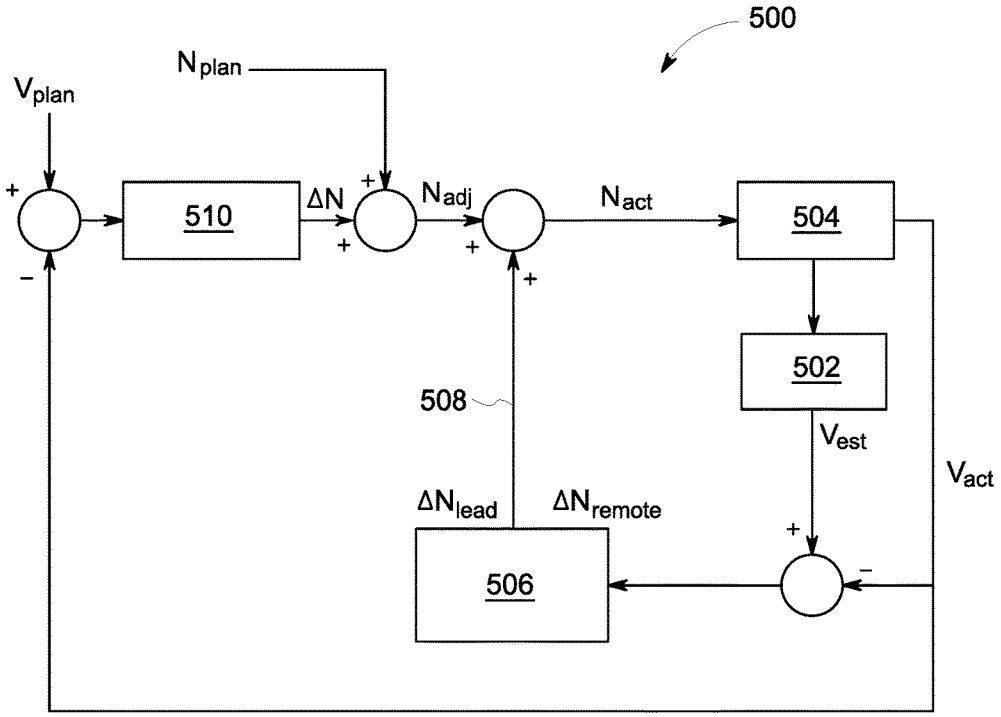
FIG. 10 is a schematic diagram that illustrates how the vehicle-motion model of FIG. 4 may be used to control a vehicle system in accordance with an embodiment.

FIG. 10 is a schematic diagram that illustrates how a control system 500 that includes an observer module 502 may be used to control operation of a vehicle system 504. In the illustrated embodiment, the control system 500 may compare the speeds of different vehicles at different positions along the vehicle system 504 to determine how the different vehicles are moving relative to one another. More specifically, the control system 500 may determine how quickly the different vehicles are approaching each other or moving away from each other. Optionally, the control system 500 may determine how different groups of system vehicles are moving with respect to one another.

As shown in FIG. 10, the observer module 502 may receive the actual operational settings Nact of the vehicle system 504 to determine observed speed metric of a system vehicle at a first position. The first position may be, for example, a system vehicle that is, ⅓ of a length away from the lead system vehicle. For embodiments in which the vehicle system 504 includes multiple propulsion-generating vehicles or multiple consists, the operational settings Nact may be those operational settings that affect the system vehicle at the first position the most. For example, if the system vehicle at the first position is primarily controlled by a second locomotive, the operational settings of the second locomotive may be provided to the observer module 502.

As described above with respect to FIGS. 7 and 8, the observer module 502 may be used to estimate an observed speed $V_{est}$ of the system vehicle at the first position. The speed $V_{est}$ of the system vehicle at the first position may be compared to an actual speed $V_{act}$ of the system vehicle at second position. In this example, the system vehicle at the second position is the lead system vehicle. The control system 500 may compare the observed speed $V_{est}$ of the system vehicle at the first position to the actual speed $V_{act}$ of the system vehicle at the second position. The differences may be provided to a secondary speed regulator 506. The secondary speed regulator 506 may determine instructions 508 that indicate how the system vehicles at the first and second positions are moving relative to one another. For example, the instructions 508 may indicate how to change the operational settings of the vehicle system 504 that controls movement of the lead system vehicle and to change the operational settings of the vehicle system 504 that controls movement of the remote system vehicle. These are $\Delta N_{lead}$ and $\Delta N_{remote}$, respectively.

In addition to the above, the actual speed $V_{act}$ of the lead system vehicle may be compared to the planned speed $V_{plan}$ of the lead system vehicle. The difference between the actual speed $V_{act}$ of the lead system vehicle and the planned speed $V_{plan}$ of the lead system vehicle may be provided to a primary speed regulator 510 of the control system 500. The primary speed regulator 510 may determine instructions ΔN for changing the operational settings so that the actual speed $V_{act}$ of the lead system vehicle approaches the planned speed $V_{plan}$ of the lead system vehicle. The adjusted operational settings ΔN may then be applied to the planned operational settings $N_{plan}$, which is then combined with $\Delta N_{lead}$ and $\Delta N_{remote}$.

It is contemplated that the embodiments of FIGS. 6-10 may be modified and/or combined with one another. For example, the embodiment of FIG. 10 may be combined with the embodiment of FIGS. 7 and 8. More specifically, an observer module (not shown) may receive the actual speed $V_{act}$ of the lead system vehicle and use the actual speed $V_{act}$ to estimate or observe a CM speed $V_{est\ cm}$ of the vehicle system. The estimated CM speed $V_{est\ cm}$ of the vehicle system may then be compared to a CM speed $V_{plan\ cm}$ of the vehicle system based on the trip plan. The primary speed regulator 510 may use any differences between the estimated CM speed $V_{est\ cm}$ and the planned CM speed $V_{plan\ cm}$ to determine changes to the operational settings of the current trip plan. The adjusted settings $N_{adj}$ may then be further modified based on the instructions 508. Alternatively, the embodiment of FIG. 10 may be combined with the embodiment of FIG. 9. In this case, the actual speed $V_{act}$ of the lead system vehicle may be compared to the planned speed $V_{plan}$ of the lead system vehicle, which may be calculated using a vehicle-motion model. The primary speed regulator 510 may use any differences between the actual speed $V_{act}$ of the lead system vehicle and the planned speed $V_{plan}$ of the lead system vehicle to determine changes to the operational settings of the current trip plan. The adjusted settings $N_{adj}$ may then be further modified based on the instructions 508.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims. The various embodiments are not limited to the arrangements and instrumentality shown in the drawings.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A system comprising:

a control system used to control operation of a vehicle system, the vehicle system including a plurality of system vehicles in which adjacent system vehicles are operatively coupled such that the adjacent system vehicles are permitted to move relative to one another, the vehicle system exhibiting system-handling metrics as the vehicle system moves along the route, the control system including one or more processors that are configured to:

(a) generate, as the vehicle system moves along the route, a plurality of different trial plans for an upcoming segment of the route, the trial plans including potential operational settings of the vehicle system along the route;

(b) select one of the trial plans as a selected plan or generate the selected plan based on one or more of the trial plans, the selected plan configured to improve one or more system-handling metrics as the vehicle system moves along the upcoming segment of the route; and (c) communicate instructions to change at least one of the operational settings of the vehicle system based on the selected plan or decide to not change any operational settings;

wherein the adjacent system vehicles are physically connected by couplers; and wherein the selected plan is configured to reduce along the upcoming segment, compared to the current trip plan, a risk of damage to the couplers that is caused by rope forces or dynamic forces being excessive.

2. The system of claim 1, wherein the one or more processors are also configured to: (d) repeat (a) through (c) a plurality of times along the route.

3. The system of claim 2, wherein (a)-(d) constitute a model predictive control (MPC) process.

4. The system of claim 1, wherein the plurality of different trial plans are iteratively or recursively generated such that performance of the vehicle system converges upon a desired outcome that is based upon an objective function, the selected plan being based on at least one of the trial plans.

5. The system of claim 4, wherein the plurality of different trial plans are iteratively or recursively generated until a condition is satisfied.

6. The system of claim 1, wherein each of the plurality of different trial plans specify operational settings from a first position to a second position, the selected plan better improving, compared to at least one other trial plan, the one or more system-handling metrics.

7. The system of claim 1, wherein the selected plan is not any of the trial plans but is a function of at least one of the trial plans.

8. The system of claim 1, wherein the operational settings provide at least one of tractive efforts and braking efforts.

9. The system of claim 1, wherein the vehicle system is configured to be controlled in accordance with a current trip plan that dictates operational settings that provide at least one of tractive efforts and braking efforts of the vehicle system along the route.

10. The system of claim 1, wherein the system-handling metrics include or are directly related to at least one of: (a) relative acceleration between the system vehicles or groups of the system vehicles along the upcoming segment; (b) relative speed between the system vehicles or groups of the system vehicles along, the upcoming segment; (c) relative momentum between the system vehicles or groups of the system vehicles along the upcoming segment; (d) relative displacement between the system vehicles or groups of the system vehicles along the upcoming segment; (e) difference between relative displacement and steady state displacement between the system vehicles or groups of the system vehicles; (f) difference between estimated dynamic force and steady state force between the system vehicles or groups of the system vehicles; (g) a time derivative of forces between the system vehicles or groups of the system vehicles; (h) a product between forces and time derivative of force between the system vehicles or groups of the system vehicles; (i) compression or expansion forces between the system vehicles; (j) rope forces between the system vehicles; (k) a function of the coupler forces and/or the rope forces; (l) or a function that includes some or all of the above.

11. The system of claim 10, wherein the system vehicles form a plurality of groups, the groups including a series of coupled system vehicles, wherein the forces and/or relative speeds between the adjacent system vehicles in a common group are assumed to be sufficiently close when generating the trial plans.

12. The system of claim 1, wherein each of the trial plans is based on predicted forces over time, vehicle system data, and route data.

13. The system of claim 1, wherein the one or more processors are also configured to obtain a reference metric of the vehicle system as the vehicle system moves along the route, the trial plans generated by the one or more processors being based on the reference metric.

14. The system of claim 1, wherein the vehicle system is a train and the system vehicles include at least one locomotive configured to provide tractive efforts and a plurality of rail vehicles.

15. A method comprising:

(a) generating a plurality of different trial plans for an upcoming segment of a route, the trial plans including potential operational settings of a vehicle system along the route, the vehicle system including a plurality of system vehicles in which adjacent system vehicles are operatively coupled permitting the adjacent system vehicles to move relative to one another, the vehicle system exhibiting system-handling metrics as the vehicle system moves along the route;

(b) selecting one of the trial plans as a selected plan or generating the selected plan based on one or more of the trial plans, the selected plan configured to improve one or more system-handling metrics as the vehicle system moves along the upcoming segment of the route;

(c) communicating instructions to change at least one of the operational settings of the vehicle system based on the selected plan or decide to not change any operational settings;

wherein the adjacent system vehicles are physically connected by couplers; and wherein the selected plan is configured to reduce along the upcoming segment, compared to the current trip plan, a risk of damage to the couplers that is caused by rope forces or dynamic forces being excessive.

16. The method of claim 15, further comprising: (d) repeating (a) through (c) a plurality of times as the vehicle system moves along the route.

17. The method of claim 16, wherein (a)-(d) constitute a model predictive control (MPC) process and are performed by an off-board control system, wherein (c) includes communicating the instructions to the vehicle system from the off-board control system.

18. The method of claim 15, wherein the plurality of different trial plans are iteratively or recursively generated such that performance of the vehicle system converges upon a desired outcome that is based upon an objective function, the selected plan being based on at least one of the trial plans.

19. A tangible and non-transitory computer readable medium configured to control operation of a vehicle system, the vehicle system including a plurality of system vehicles in which adjacent system vehicles are operatively coupled permitting the adjacent system vehicles to move relative to one another, the vehicle system exhibiting system-handling metrics as the vehicle system moves along the route, the computer readable medium comprising one or more programmed instructions configured to direct one or more processors to:

(a) generate, as the vehicle system moves along the route, a plurality of different trial plans for an upcoming segment of the route, the trial plans including potential operational settings of the vehicle system along the route;

(b) select one of the trial plans as a selected plan or generate the selected plan based on one or more of the trial plans, the selected plan configured to improve one or more system-handling metrics as the vehicle system moves along the upcoming segment of the route; and (c) change at least one of the operational settings of the vehicle system based on the selected plan or decide to not change any operational settings;

wherein the adjacent system vehicles are physically connected by couplers; and wherein the selected plan is configured to reduce along the upcoming segment, compared to the current trip plan, a risk of damage to the couplers that is caused by rope forces or dynamic forces being excessive.

* * * * *